US005680969A

United States Patent [19]

Gross

[11] Patent Number: 5,680,969

[45] Date of Patent: Oct. 28, 1997

[54] CLOSURE WITH DISPENSING VALVE AND SEPARATE RELEASABLE INTERNAL SHIPPING SEAL

[75] Inventor: Richard A. Gross, Oconomowoc, Wis.

[73] Assignee: AptarGroup, Inc., Crystal Lake, Ill.

[21] Appl. No.: 575,730

[22] Filed: Dec. 18, 1995

[51] Int. Cl.[6] ..... B65D 35/38

[52] U.S. Cl. ..... 222/494; 222/520; 222/525

[58] Field of Search ..... 222/494, 493, 222/520, 525, 213; 215/271; 220/254

[56] References Cited

U.S. PATENT DOCUMENTS

| | | | |
|---|---|---|---|
| 1,989,714 | 2/1935 | Statham . | |
| 1,996,156 | 4/1935 | Janssen . | |
| 2,679,954 | 6/1954 | Barnes . | |
| 2,942,762 | 6/1960 | Fahr . | |
| 2,998,902 | 9/1961 | Thomas et al. | 222/525 |
| 3,067,787 | 12/1962 | Salk . | |
| 3,669,323 | 6/1972 | Harker et al. . | |
| 3,887,116 | 6/1975 | Ishikawa et al. | 222/520 |
| 4,269,330 | 5/1981 | Johnson . | |
| 4,506,809 | 3/1985 | Corsette | 222/525 |
| 4,728,006 | 3/1988 | Drobish et al. . | |
| 4,749,108 | 6/1988 | Dornbusch et al. . | |
| 4,941,598 | 7/1990 | Lambelet, Jr. . | |
| 4,969,581 | 11/1990 | Seifert et al. . | |
| 4,991,745 | 2/1991 | Brown . | |
| 5,033,647 | 7/1991 | Smith et al. . | |
| 5,033,655 | 7/1991 | Brown . | |
| 5,115,950 | 5/1992 | Rohr . | |
| 5,161,718 | 11/1992 | Gueret | 222/494 |
| 5,213,236 | 5/1993 | Brown et al. . | |
| 5,271,531 | 12/1993 | Rohr et al. . | |
| 5,339,995 | 8/1994 | Brown et al. . | |
| 5,377,877 | 1/1995 | Brown et al. . | |
| 5,409,144 | 4/1995 | Brown . | |
| 5,439,143 | 8/1995 | Brown et al. . | |

FOREIGN PATENT DOCUMENTS

| | | | |
|---|---|---|---|
| 160336 | 11/1985 | European Pat. Off. . | |
| 253495 | 1/1988 | European Pat. Off. . | |
| 296103 | 12/1988 | European Pat. Off. | 222/525 |
| 1474620 | 5/1977 | United Kingdom . | |

*Primary Examiner*—Philippe Derakshani

*Attorney, Agent, or Firm*—Dressler, Rockey, Milnamow & Katz, Ltd.

[57] ABSTRACT

A closure is provided for the opening to a container. The body defines a discharge aperture communicating with the housing. A housing is disposed on the body for movement between a lowered position and an elevated position. The housing defines a dispensing passage for establishing communication between the body discharge aperture and the exterior of the housing. The housing includes a dispensing valve disposed in the dispensing passage for opening to dispense fluid therethrough and for closing to occlude flow. The housing includes an occlusion member or plug between the valve and the body discharge aperture to prevent flow from the discharge aperture into the dispensing passage below the valve when the housing is in the lowered position and to permit flow into the dispensing passage when the housing is in the elevated position.

26 Claims, 16 Drawing Sheets

136
45
82
80
84
44
78
39
76
74
40
45
80
44
42
98
100
96
102
46
104
90
94
94
92
92
48
128
110
116
114
112
66
62
64
122
120
60
56
58
50
52
54
68
70
72

CLOSURE WITH DISPENSING VALVE AND SEPARATE RELEASABLE INTERNAL SHIPPING SEAL

TECHNICAL FIELD

This invention relates to container closures. The invention is particularly suitable for use with a squeeze-type container dispensing closure having a valve which opens to dispense a fluid product from the container when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a flexible, self-closing, slit-type dispensing valve mounted over the container opening. The valve has a slit or slits which define a normally closed orifice that opens to permit fluid flow therethrough in response to increased pressure within the container when the container is squeezed. The valve automatically closes to shut off fluid flow therethrough upon removal of the increased pressure.

Closure designs have been proposed for such valves, and examples are illustrated in the U.S. Pat. No. 5,271,531. Typically, the closure includes a base mounted on the container neck to define a seat for receiving the valve and includes a retaining ring or housing structure for holding the valve on the seat in the base.

The closure can be provided with a hinged lid for covering the valve during shipping or when the container is packed for travel (or when the container is otherwise not in use). See, for example, FIGS. 31–34 of U.S. Pat. No. 5,271,531. The lid can keep the valve clean and/or protect the valve from damage. However, the presence of the lid when opened may be objectionable to some users in some applications.

Typically, it is intended that the lid be opened initially by the user and then be left open. The slit valve remains sealed closed unless and until the container is squeezed with sufficient force to cause the valve to open and dispense some of the container contents.

A conventional lid can also be designed to prevent leakage through the valve under container pressurization conditions when the lid is closed. For example, the lid disclosed in the U.S. Pat. No. 5,271,531 has a valve-engaging member, and the lid can be closed so that the valve-engaging member acts directly on the exterior of the flexible slit-type valve for generally preventing the valve from opening (e.g., during shipping or storage when the container is subjected to impacts or squeezing forces).

Some consumers notice the valve-engaging member on the lid and understand how the lid provides an exterior sealing of the valve when the lid is closed. Such consumers may then think that they should always close the lid after use rather than leave the lid open. Such consumers consequently fail to enjoy the convenience of leaving the lid open and relying solely on the self-closing valve during normal use. Thus, it would be desirable to provide an improved closure system that could be sealed against overpressure conditions during shipping but that would not require a lid with a visible special structure for engaging the exterior of the valve.

There is another reason why it would be desirable to eliminate the need for an exterior lid to seal a slit-type valve closed against overpressure conditions. Specifically, from a manufacturing standpoint, it can be difficult to make a low cost, mass produced closure wherein the lid can always effectively seal the slit-type valve closed against overpressure conditions without a slight leakage. Although such a lid is designed to engage the exterior of the valve to hold the valve closed, the interior surface of the valve remains subjected to the container contents and pressure. Thus, the container contents can still be forced against, and contact, the interior surface of the valve. In some cases, depending upon the design and/or manufacturing tolerances, there nevertheless may be some small amount of leakage of the container contents through the valve slits and against the closed lid owing to overpressure conditions during shipping.

Further, with some closure and valve configurations, it may not be commercially practicable to design a lid which can hold the exterior of the valve closed. Also, in some applications it may be desirable to avoid long-term contact between the container contents and the inside surface of the valve during shipping and during warehouse storage (e.g., where such long-term contact might result in a slight deleterious chemical or physical change in the valve material).

It would be desirable, therefore, to provide an improved closure system that could be even more conveniently used with a dispensing valve and that eliminates the need for a hinged, exterior lid.

It would also be desirable to provide an improved closure wherein the valve can be effectively sealed off from contact with the container contents during shipping or when otherwise desired.

Additionally, it would be beneficial if the closure components could be provided with an improved system for readily accommodating the assembly of the components during manufacture of the closure.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, a closure is provided for an opening to a container interior. The closure provides a leak-tight seal which is especially useful when the container is shipped or packed by a user for travel.

The invention is especially suitable for use with closures having a dispensing valve because the closure seal can be disposed between the valve and the container contents. This prevents the valve from being exposed to any of the hydraulic pressures in the container until the container is ready for use. The container remains securely sealed during shipping and when it is packed for travel. Because the sealing system is internal and not visible to the user, the user, once having initially unsealed the container to permit operation of the valve, will be more likely to subsequently leave the container in the unsealed condition for more convenient dispensing by action of the self-closing valve alone.

The closure includes a body for mounting to the container at the opening. The body defines a discharge aperture for communicating with the opening.

A housing is disposed on the body for movement between a lowered position and an elevated position. The housing defines a dispensing passage for establishing communication between the body discharge aperture and the exterior of the housing. The housing includes a dispensing valve disposed in the dispensing passage for opening to dispense fluid therethrough and for closing to occlude flow.

The housing also includes an occlusion member or plug between the valve and the body discharge aperture to prevent flow from the discharge aperture into the dispensing passage below the valve when the housing is in the lowered position. However, flow is permitted into the dispensing passage when the housing is in the elevated position.

When the housing is in the lowered position, the dispensing valve is effectively sealed from the container contents by the occlusion member. This establishes a shipping or storage condition that prevents the dispensing valve from being subjected to hydraulic pressures. When the closure housing is in the lowered, sealing, storage position, the container may be packed for travel. When it is again desired to dispense contents from the container, the housing is raised to the elevated position. The container can then be squeezed to establish sufficient pressure in the container below the valve to open the valve for dispensing the container contents.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figures 1, 2:
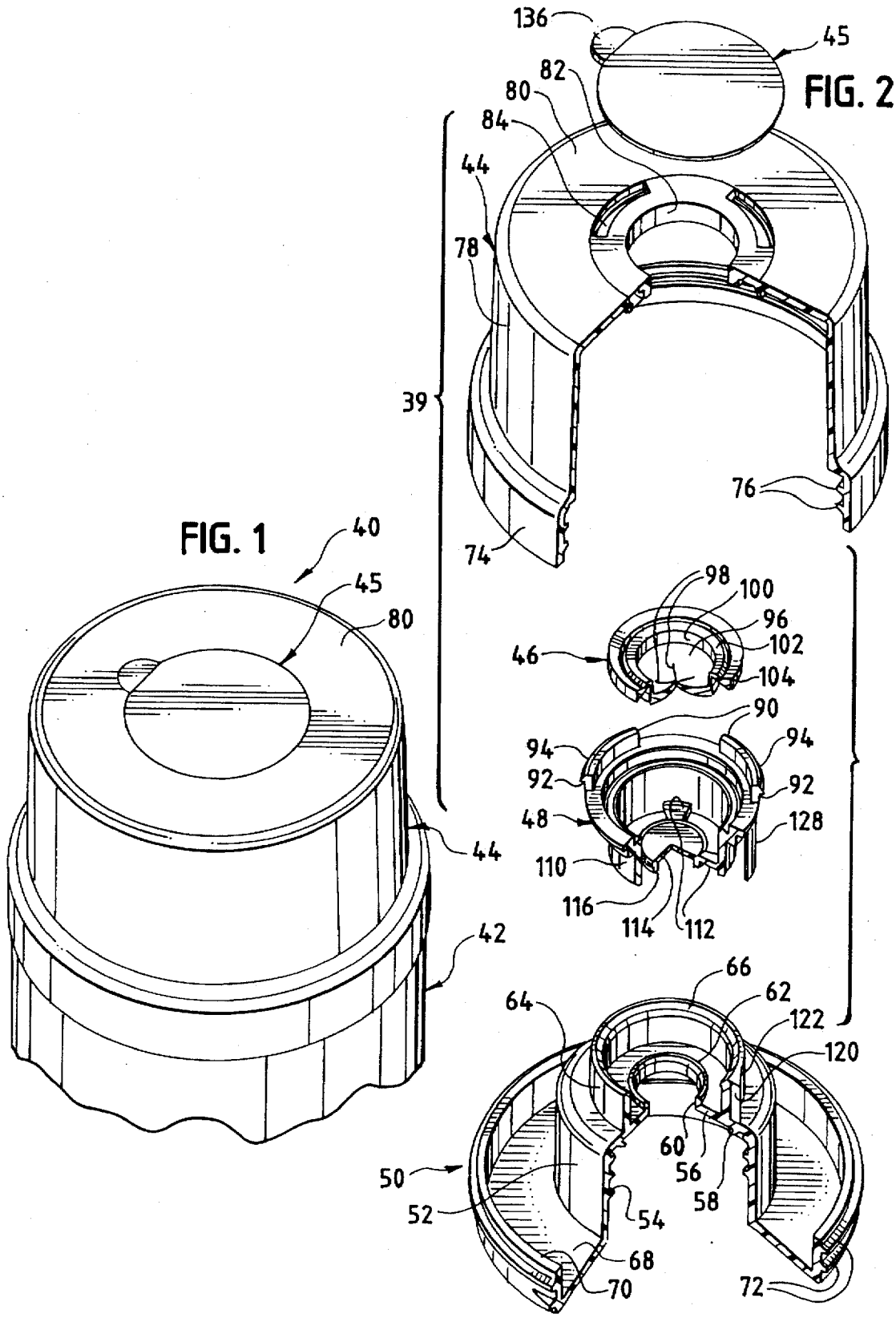
FIG. 1 is a perspective view of a first embodiment of a closure of the present invention shown with the housing in the lowered, closed position and with a disposable, external seal cover in place.
FIG. 2 is an exploded perspective view of the closure shown in FIG. 1, and FIG. 2 also shows portions cut away to illustrate interior detail.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in various positions, and terms such as upper, lower, horizontal, etc., are used with reference to these positions. It will be understood, however, that the closure components may be manufactured and stored in orientations other than the ones described.

With reference to the figures, a first embodiment of a closure of the present invention is illustrated in FIGS. 1–9 and is represented generally in many of those figures by reference numeral 40. The closure 40 is adapted to be disposed on a container, such as a container 42 (FIGS. 1 and 4) which has a conventional mouth or opening 41 formed by a neck 43 (FIG. 4) or other suitable structure. The neck 43 typically has a circular cross-sectional configuration, but the body of the container 42 may have another cross-sectional configuration, such as an oval cross-sectional shape, for example. The closure 40 may be fabricated from a thermoplastic material, or other materials, compatible with the container contents.

The container 42 may be stored and used in the orientation shown in FIG. 1 wherein the closure 40 is at the top of the container 42. The container 42 may also be normally stored in an inverted position (not illustrated). When stored in the inverted position, the container 42 employs the closure 40 as a support base.

The container 42 is a squeezable container having a flexible wall or walls which can be grasped by the user and compressed to increase the internal pressure within the container so as to squeeze the product out of the container when the closure is opened (as explained in detail hereinafter). The container wall typically has sufficient, inherent resiliency so that when the squeezing forces are removed, the container wall returns to its normal, unstressed shape.

The closure 40 includes a base or body 50 to which is mounted a movable housing 39 (FIG. 2). The housing 39 comprises an exterior shell 44, a removable and disposable seal cover 45, a valve 46, and a valve holder 48.

Figure 4:
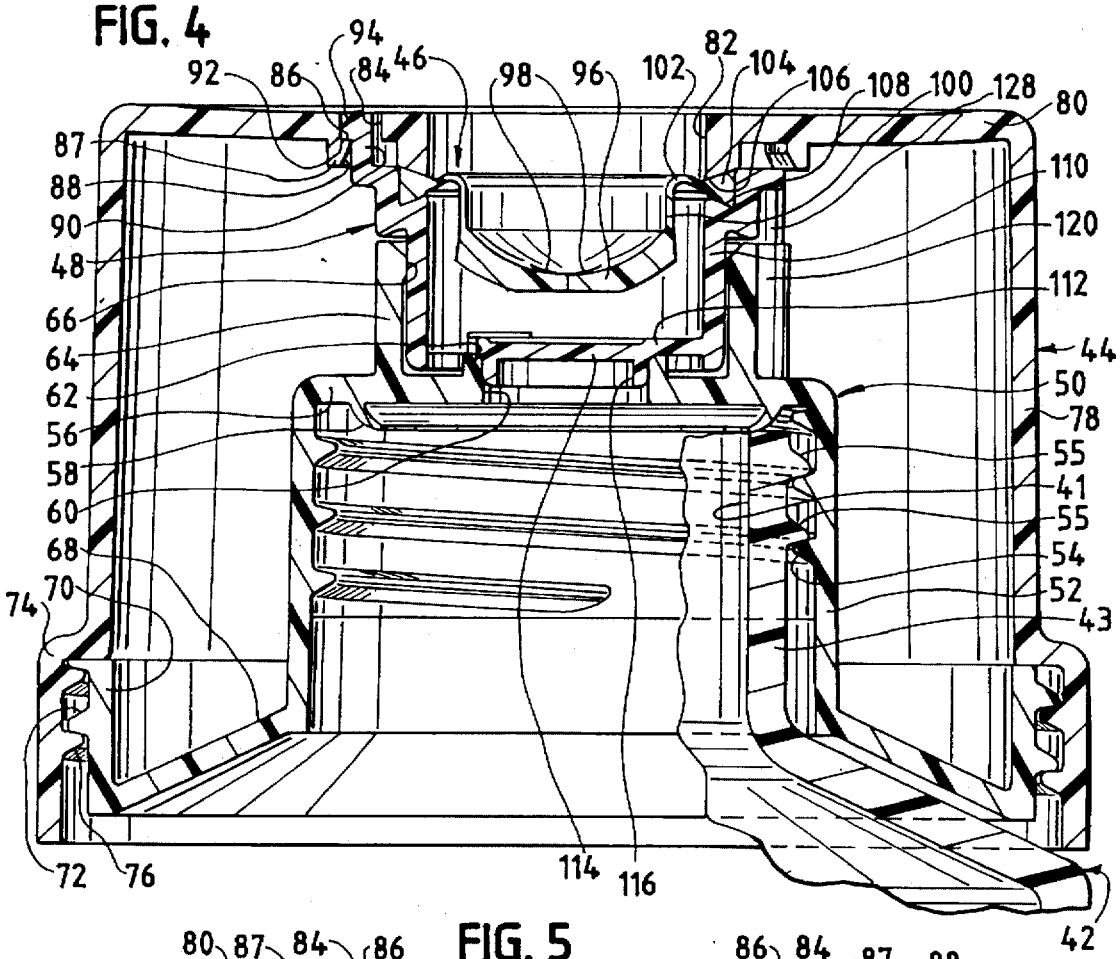
FIG. 4 is a cross-sectional view taken generally along the plane 4—4 in FIG. 3.

In the first embodiment illustrated in FIGS. 2 and 4, the body 50 includes an inner annular wall 52 which has a conventional thread 54 or other suitable means (e.g., a conventional snap-fit bead (not illustrated)) for engaging suitable cooperating means, such as a thread 55 on the container neck 43 (FIG. 4) to secure the closure body 50 to the container 42.

At the top of the annular inner wall 52, the closure body has a transverse deck 56 which extends over the upper, distal end of the container neck 43. The deck 56 has a downwardly extending, annular, flexible seal 58 which is received against the inner edge of the container neck 44 in the container neck opening 41 so as to provide a leak-tight seal between the closure body deck 56 and the container neck 43.

As illustrated in FIGS. 2 and 4, the closure body deck 56 defines a discharge aperture 60 over the container neck opening 41. A collar 62 projects upwardly from the closure body deck 56 around the discharge aperture 60. A larger diameter sleeve 64 is annularly disposed relative to the collar 62 and projects upwardly from the body deck 56 outwardly of the collar 62. The sleeve 64 defines an inwardly extending seal bead 66 near the top of the sleeve.

At the bottom of the body inner annular wall 52, the body 50 flares outwardly to define a frustoconical wall 68. At the outer periphery of the frustoconical wall 68, the body 50 has upwardly projecting, annular, outer wall 70. The exterior surface of the outer wall defines a thread 72. The closure body thread 72 is employed to engage the closure housing outer shell 44 as illustrated in FIG. 4. To this end, the housing outer shell 44 has a lower, peripheral flange 74 for being concentrically disposed about the closure body outer wall 70, and the flange 74 defines a female thread 76 for engaging the male thread 72 on the closure body annular, outer wall 70. The threads 72 and 76 function as an engaged guide system by which relative axial displacement can be effected between the closure body 50 and closure housing 39 as is explained in detail hereinafter.

Above the closure outer shell lower flange 74, the outer shell 44 has a reduced diameter, upper cylindrical wall 78 which terminates in a transverse, top wall 80. The top wall 80 defines a dispensing passage 82. Preferably, the dispensing passage 82 is centrally disposed and is concentric with the closure body discharge aperture 60 and container neck opening 41.

The dispensing passage 82 is preferably covered with the seal cover 45 (FIGS. 1 and 2). Typically, the seal cover 45 is intended to be disposable and may function as an initial tamper-evident cover which also prevents ingress of contaminants into the valve area during shipping and storage and when the container is displayed by a retailer for purchase. The cover 45 may be a plastic and/or metal foil film with a suitable adhesive coating for initially attaching the cover 45 to the transverse top wall 80 of the closure shell 44 over the dispensing passage 82. The seal cover 45 is preferably provided with a projecting tab 136 which can be conveniently grasped to assist in removing the seal cover 45.

Figure 3:
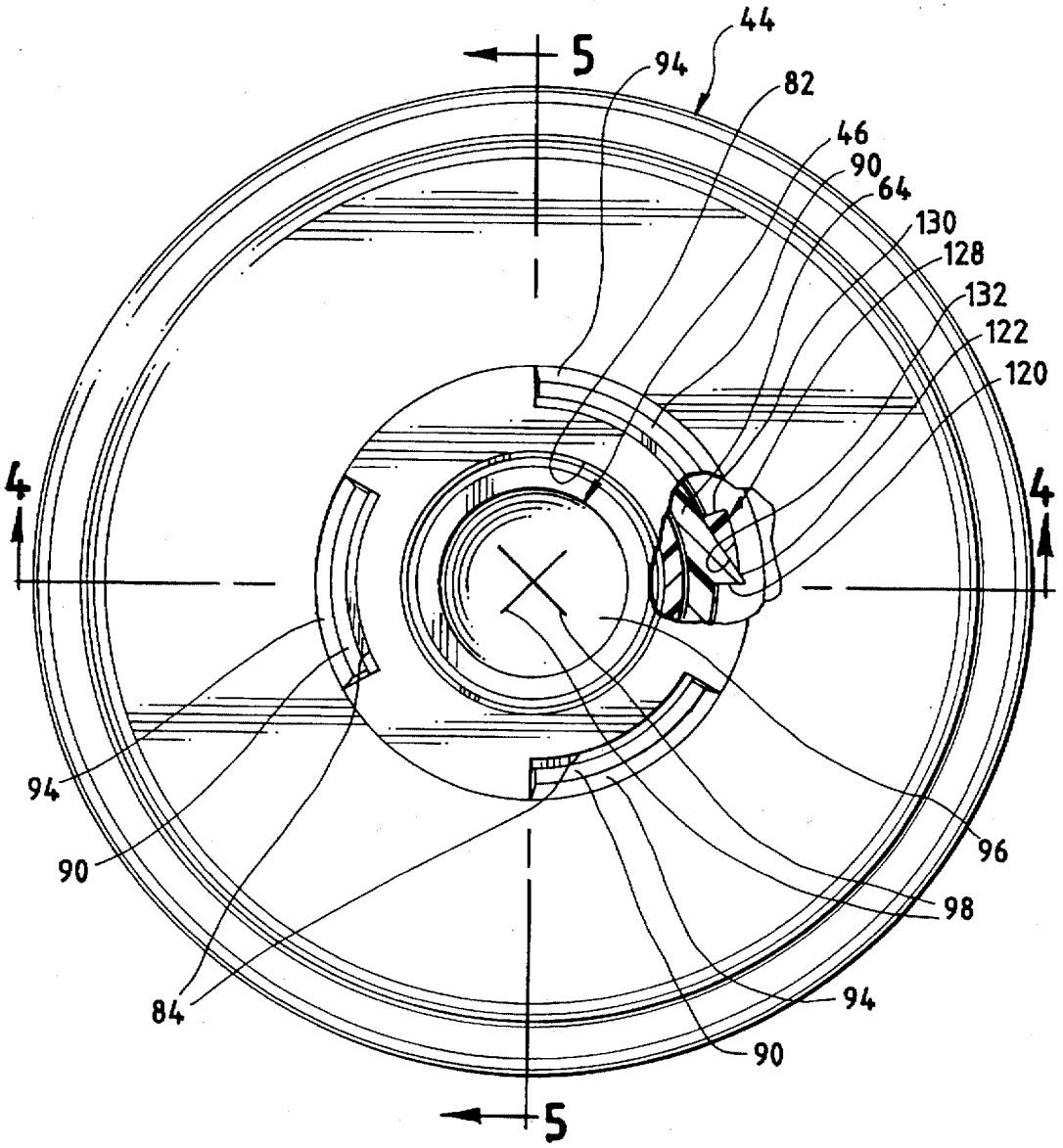
FIG. 3 is a top plan view of the closure illustrated in FIG. 1, but the closure is shown in FIG. 3 with the external seal cover removed.
Figure 5:
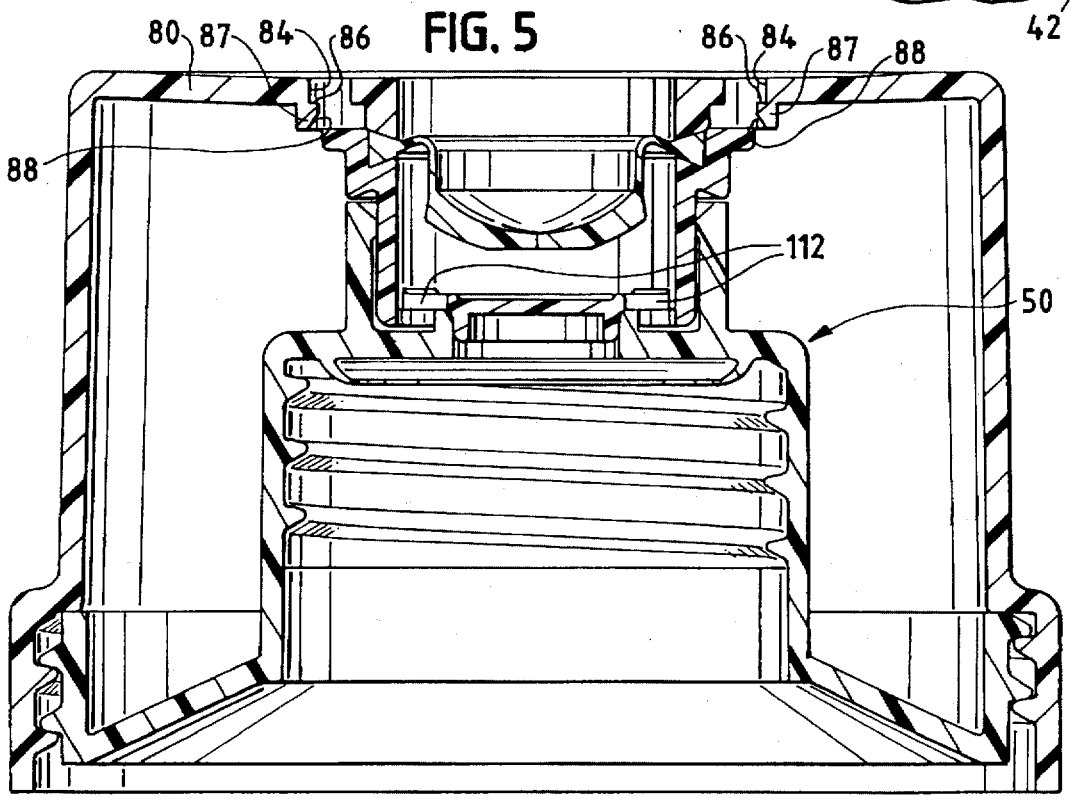
FIG. 5 is a cross-sectional view taken generally along the plane 5—5 in FIG. 3.

As illustrated in FIG. 3, the transverse top wall 80 defines three equal size slots 84 which are spaced apart at 120° increments on a circular locus concentric with the dispensing passage 82. Each slot 84 has a circular arc configuration and extends through the transverse top wall 80. The outer radial arc wall of each slot 84 terminates in a bottom shoulder 86 as illustrated in FIG. 5. The shoulder 86 extends radially inwardly and faces upwardly. Each shoulder 86 is defined by a flange 87 projecting downwardly from the transverse top wall 80 at the outer edge of the slot 84. Each flange 87 has an angled camming surface 88 as illustrated in FIG. 5.

The slots 84 form part of a retention system for holding the valve holder 48 and valve 46 to the outer shell transverse top wall 80. To this end, the valve holder 48 includes three upwardly projecting, resilient arms 90 (two of which are shown in FIG. 2, three of which are shown in FIG. 3, and one of which is shown in FIG. 4). The upper, distal end of each arm 90 has a downwardly facing lip 92 as illustrated in FIGS. 2 and 4. In order to assemble the housing 39 initially (as at a manufacturing facility), the valve 46 is placed in the valve holder 48, and the valve holder 48 is then pushed with the valve 46 upwardly against the underside of the outer shell transverse top wall 80 while the valve holder arms 90 are aligned in registry with the slots 84 in the top wall 80. Each arm 90 is elastically deformed as it is inserted through the associated slot 84. To assist in this assembly process, the distal end of each arm 90 has a curved or angled camming surface 94 for engaging the adjacent cam surface 88 on the shell flange 87 as the arms 90 move upwardly into the slots 84. When the valve holder 48 has pushed the valve 46 against the transverse top wall 80 in the dispensing passage 82, the lips 92 on the valve holder arms 90 are at an elevation that is just sufficient to clear the upwardly facing shoulders 86 in the slots 84. Each arm 90 can then spring back to its original, undeformed orientation to position the lip 92 over, and in engagement with, the adjacent slot shoulder 86. This retains the valve holder 48 on the shell 44 with the valve 46 clamped between the shell 44 and valve holder 48.

In the preferred form of the valve 46 illustrated, the valve 46 is of a known design employing a flexible, resilient material, which can open to dispense fluid. The valve 46 may be fabricated from thermosetting elastomeric materials such as silicone, natural rubber, and the like. It is also contemplated that the valve 46 may be fabricated from thermoplastic elastomers based upon materials such as thermoplastic propylene, ethylene, urethane, and styrene, including their halogenated counterparts. A preferred form of the valve 46 is disclosed in the U.S. Pat. No. 5,439,143. The description of the valve disclosed in the U.S. Pat. No. 5,439,143 is incorporated herein by reference to the extent pertinent and to the extent not inconsistent herewith.

As illustrated in FIG. 4, the valve 46 includes a flexible, central wall 96 which has an outwardly concave configuration and which defines at least one, and preferably two, dispensing slits 98 extending through the central wall 96. A preferred form of the valve 46 has two, mutually perpendicular, intersecting slits 98 of equal length. The intersecting slits 98 define four, generally sector-shaped, flaps or petals in the concave, central wall 96. The flaps open outwardly from the intersection point of the slits 98 in response to increasing pressure of sufficient magnitude in the well-known manner described in the U.S. Pat. No. 5,439,143.

The valve 46 includes a skirt 100 (FIG. 4) which extends outwardly from the valve central wall 96. At the outer (upper) end of the skirt 100 there is a thin, annular flange 102 (FIG. 4) which extends peripherally from the skirt 100 in a downwardly angled orientation. The thin flange 102 terminates in an enlarged, much thicker, peripheral flange 104 which has a generally dovetail shaped transverse cross section.

To accommodate the seating of the valve 46 in the valve holder 48, the underside of the housing deck 80 defines an annular, downwardly facing, angled clamping surface 106 for engaging the top of the valve flange 104. The bottom of the valve flange 104 is engaged by an annular shoulder in the valve holder 48 which defines an upwardly angled, annular seating surface 108.

The spacing between the deck clamping surface 106 and the valve holder seating surface 108 increases with increasing radial distance from the center of the valve 46. Such a configuration defines an annular cavity with a transverse cross section having a dovetail shape which generally conforms to the Cross-sectional shape of the valve flange 102.

This clamping arrangement securely holds the valve 46 in the valve holder 48 without requiring special internal support structures or bearing members adjacent the interior surface of the valve cylindrical skirt 100. This permits the region adjacent the interior surface of the valve skirt 100 to be substantially open, free, and clear so as to accommodate movement of the valve skirt 100.

Figure 8:
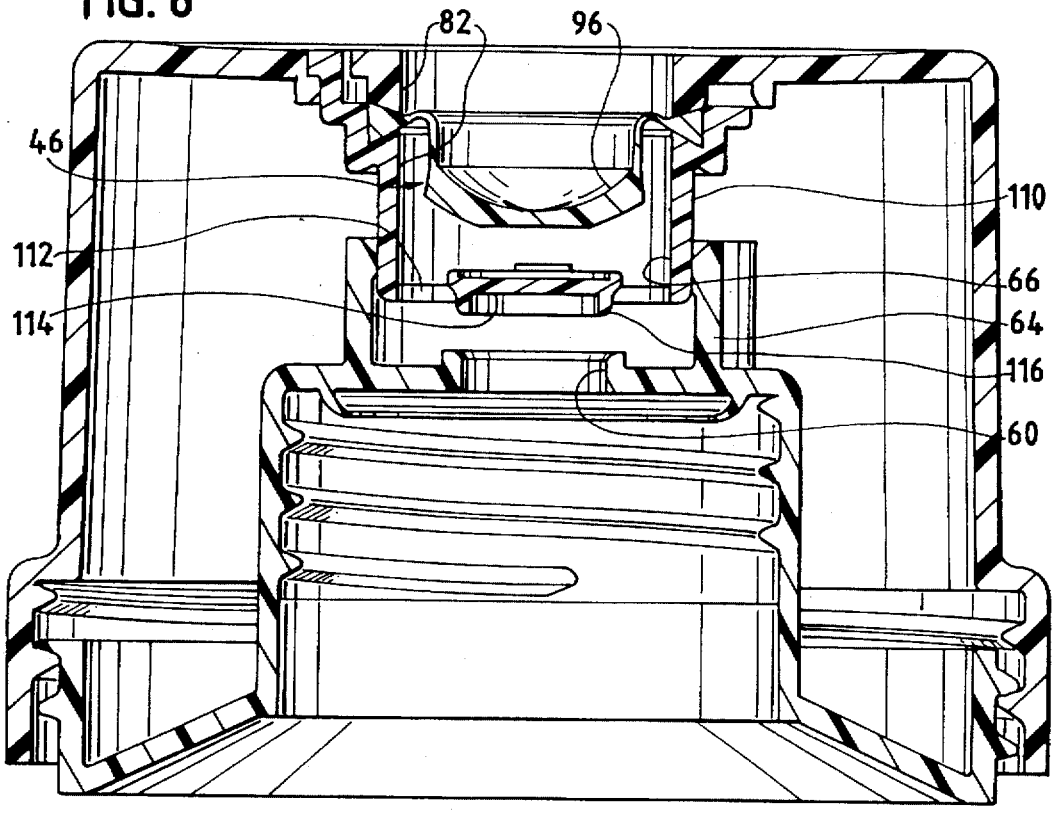
FIG. 8 is a cross-sectional view taken generally along the plane 8—8 in FIG. 7.

When the valve 46 is properly mounted within the valve holder 48 as illustrated in FIGS. 4 and 8, the valve 46 is recessed relative to the outer, top surface of the housing shell deck 80. This affords substantial protection of the valve 46 and generally reduces the likelihood that the valve will be inadvertently contacted or damaged by external instrumentalities when the closure seal cover 45 is removed to allow the container contents to be dispensed as desired. However, when the container is squeezed and the contents are being dispensed through the valve 46 (as described in detail in the U.S. Pat. No. 5,439,143), then the valve central wall 96 is forced outwardly from its recessed position.

Figure 17:
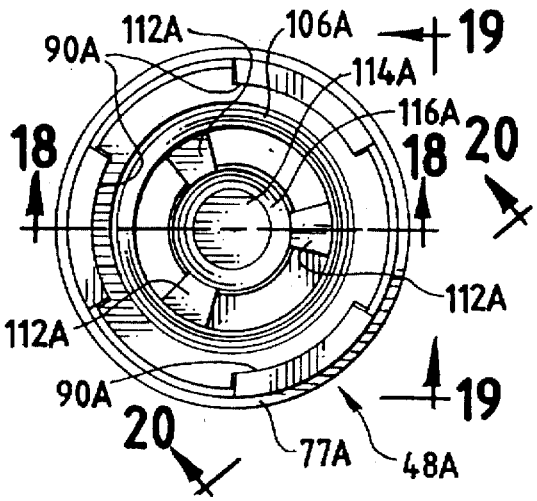
FIG. 17 is a top plan view of the valve holder shown in FIG. 16.

The valve holder 48 also includes a downwardly extending annular wall 110 (FIGS. 2 and 4). The wall 110 defines a continuation of the dispensing passage 82 below the valve 46. Projecting radially inwardly from the lower end of the wall 110 are three arms 112 (two of which are visible in FIGS. 2 and 17), and the arms 112 support a centrally disposed baffle plate, plug, or occlusion member 114. The arms 112 are circumferentially spaced at 120° increments.

The baffle plate 114 is a disk-like structure which also functions as occlusion member or plug for blocking flow through the discharge aperture 60 as shown in FIG. 4. An annular sealing skirt 116 projects downwardly from the bottom surface of the baffle plate 114, and the sealing skirt 116 is received within the discharge aperture 60 so as to create a leak-tight seal as illustrated in FIG. 4.

Figure 9:
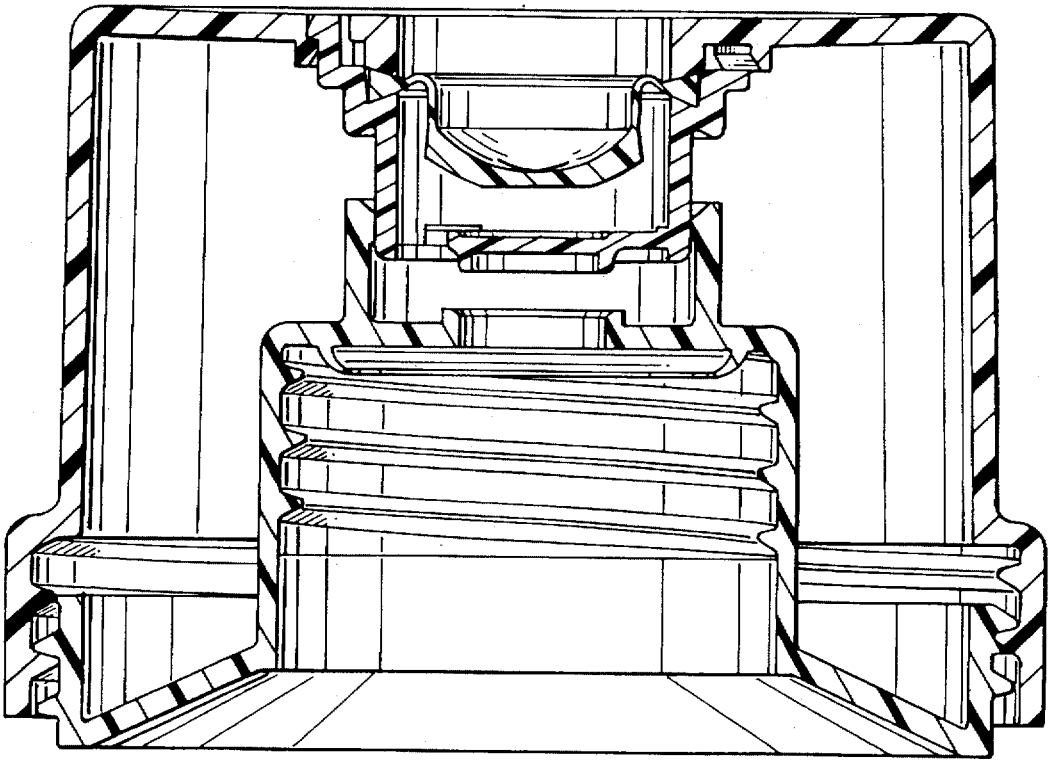
FIG. 9 is a cross-sectional view taken generally along the plane 9—9 in FIG. 7.
Figure 10:
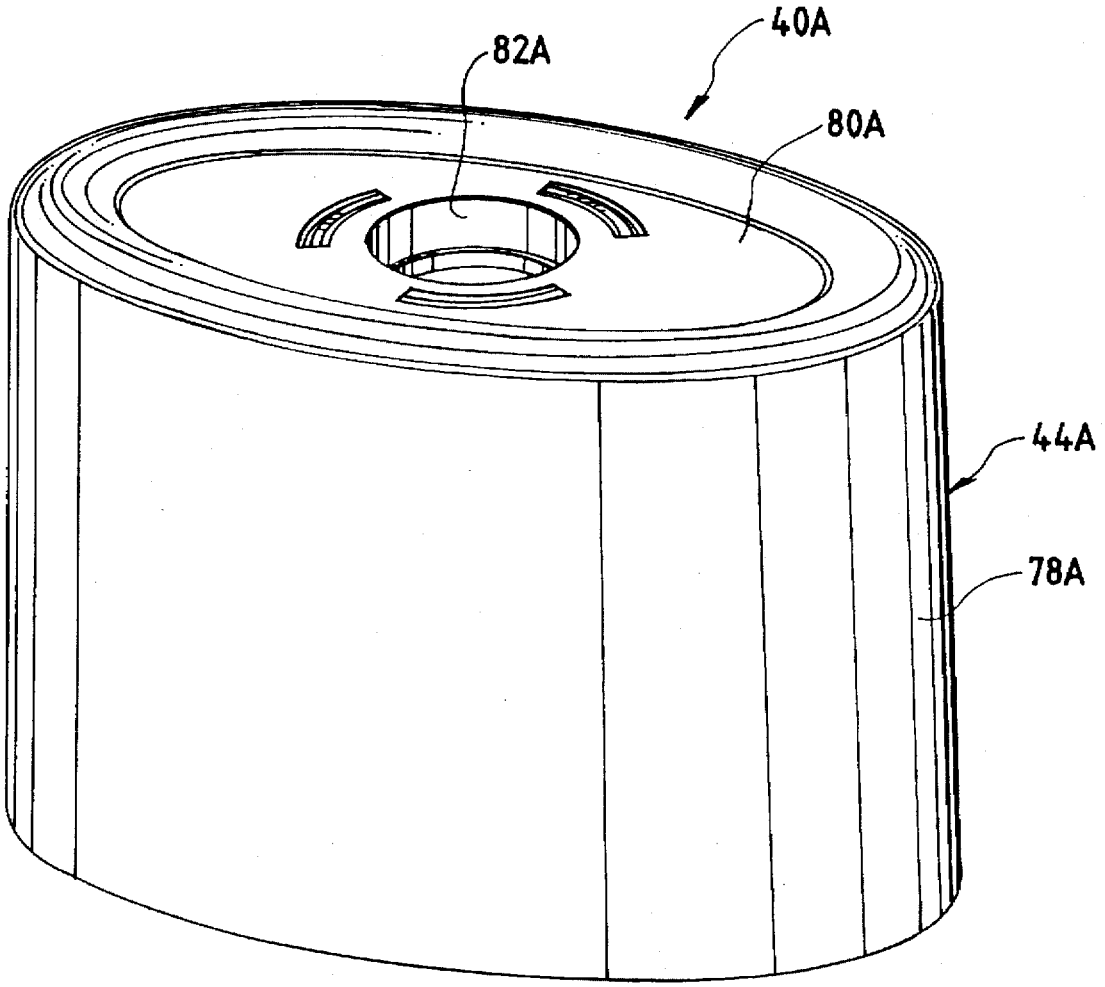
FIG. 10 is a perspective view of a second embodiment of the closure of the present invention shown with the housing in the lowered, closed position and with no external seal cover.

The baffle plate 114 and sealing skirt 116 are adapted to move with the entire housing 39 (which comprises the valve holder 48, valve 46, housing shell 44, and seal cover 45) between the lowered closed, position (FIGS. 4 and 5) and the elevated open position (FIGS. 8 and 9). In the elevated position, the exterior surface of the valve holder annular wall 110 remains in leak-tight, sealing engagement with the seal bead 66 on the inner surface of the closure body sleeve 64. This defines a closed passage beneath the valve 46 and above the discharge aperture 60. When the contents of the container are dispensed through the discharge aperture 60, the contents flow through the discharge aperture 60, past the baffle plate 114, between the arms 112, and into the region below the valve 46 in the dispensing passage 82. The container contents can then be dispensed through the valve 46 if the valve is forced open by sufficient internal pressure generated by squeezing the container in the known manner (as described in detail in U.S. Pat. No. 5,429,143).

It will be appreciated that the baffle plate 114 also functions to minimize undesirable impacts on the inside of the valve 46, as when the container is being squeezed excessively hard or shaken.

When the closure 40 is manufactured and initially assembled on the container 42, the closure is typically initially arranged in the lowered, closed condition (FIGS. 3–5). This is also the condition in which the container 42 can be conveniently carried in a user's suitcase while the user is travelling. In the closed condition, increased pressure in the container will be prevented from acting on the valve 46 because of the occlusion of the closure body discharge aperture 60 by the baffle plate or occlusion member 114.

When it is desired to dispense some or all of the contents from the container 42, the closure can be placed in the open condition (FIGS. 8 and 9). This is conveniently effected by rotating the closure shell 44 (in the counterclockwise direction looking down on the top of the housing shell 44 as viewed in FIGS. I and 3). The threaded engagement between the housing shell 44 and the closure body 50 results in the relative axial displacement between the closure body 50 and the closure housing 39 (which includes the shell 44 along with the valve holder 48 and valve 46 mounted thereto).

It is anticipated that the frictional resistance between the closure shell thread 76 and the closure body thread 72 will be considerably less than the frictional resistance between the container neck thread 55 and the mating closure body thread 54. The container neck thread 55 and closure body thread 54 (FIG. 4) will have significant frictional engagement (owing to automatic assembly of the components by machinery employed by the manufacturer). The frictional engagement is great enough to resist subsequent torque forces applied to the container and closure by the user. Accordingly, when the user applies differential torque to the closure shell 44 and container 42, the threaded engagement between the container neck 43 and closure 40 will not loosen. Instead, the closure shell 44 will rotate relative to the closure body 50. If desired, an additional mechanical deformation engagement system could be provided in the threaded regions of the closure body 50 and container neck 43 to insure that the closure body 50 and container 42 remain locked together against relative rotation when the user applies torque to the closure body shell 44 in container 42.

A system is provided for establishing the maximum axial displacement between the closure body 50 and the closure housing shell 44. For example, in the fully closed position, the axial movements of the closure body 50 and housing shell 44 toward each other could be limited by the engagement between the baffle plate or occlusion member 114 and the closure body collar 62 (FIGS. 4 and 5). Preferably, however, other structural features are employed to establish such a travel limit. In particular, the top of the wall 70 engages the top inside (horizontal) surface of the flange 74.

Figure 6:
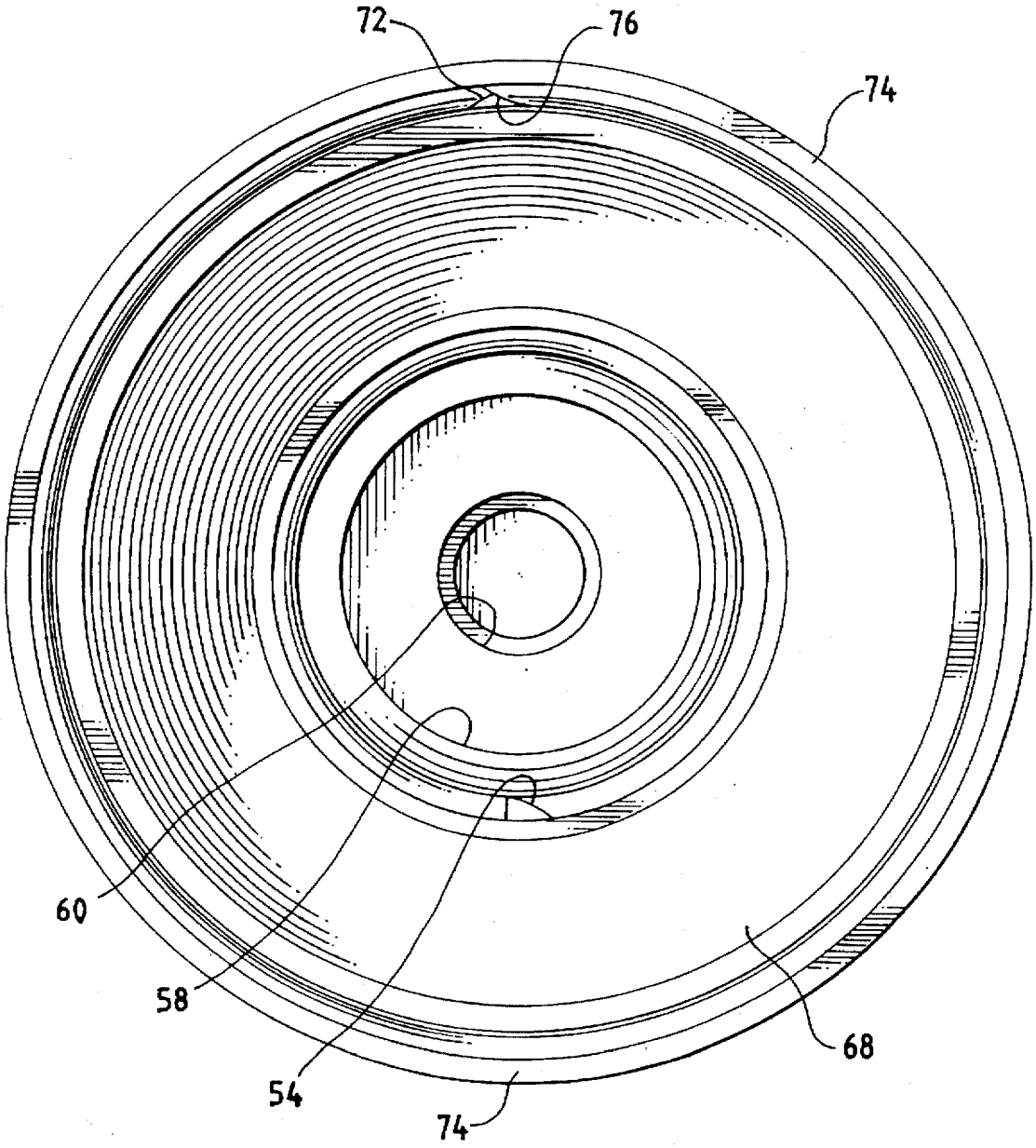
FIG. 6 is a bottom plan view of the closure illustrated in FIG. 1.

On the other hand, when the closure housing shell 44 is rotated to raise the housing 39 relative to the closure body 50, a rotation limit structure operates to limit the rotation at the predetermined, maximum opening elevation (FIGS. 8 and 9). In particular, as illustrated in FIG. 2, the closure body sleeve 64 includes a radially outwardly projecting abutment defined by a radial abutment face 120 and an angled surface 122. As illustrated in FIGS. 3 and 6, the radial abutment face 120 forms an acute angle with the surface 122. The abutment face 120 is preferably a planar surface lying on a radius of the cylindrical annular wall 64 of the closure body 50.

The closure body abutment face 120 is designed to be engaged by a stop member or rib 128 on the valve holder 48. As illustrated in FIGS. 2 and 4, the rib 128 projects downwardly from the upper peripheral portion of the valve holder 48 on the periphery. As illustrated in FIG. 3, the rib 128 has an engaging face 130 which lies in a plane oriented radially relative to the generally circular configurations of the valve holder 48 and closure body 50. The rib 128 also has an inner, angled surface 132 which faces generally inwardly. When the closure housing shell 44 and the attached valve holder 48 are in the lowered, closed position (FIGS. 3–5), the inner angled surface 132 of the rib 128 is substantially parallel to, and lies generally alongside, the angled surface 122 of the closure body abutment projection.

Figure 7:
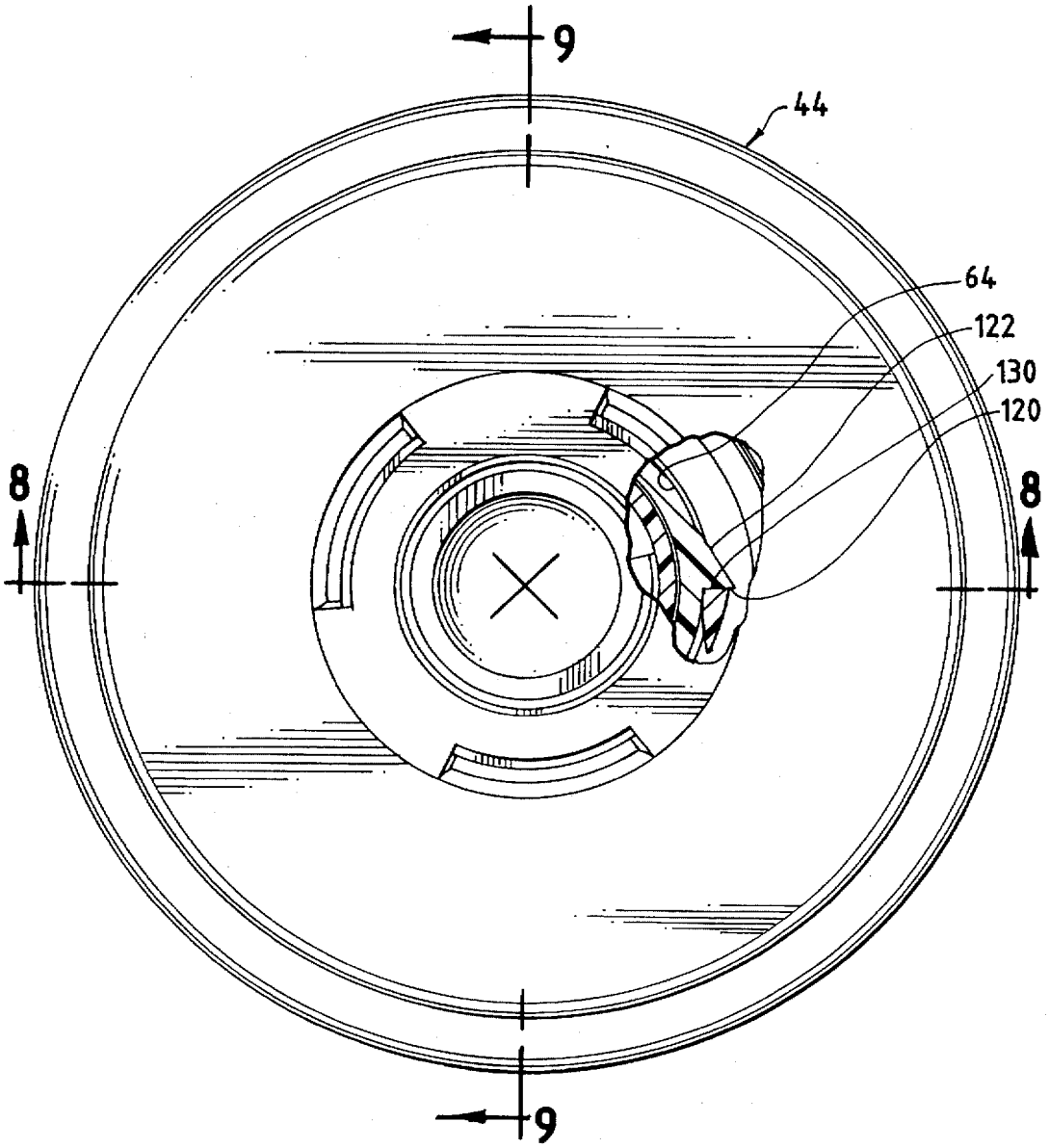
FIG. 7 is a top plan view similar to FIG. 3, but FIG. 7 shows the closure housing rotated nearly 360° to an elevated, unsealed orientation.

To place the closure 40 in the open condition, the closure shell 44 is rotated (counterclockwise as viewed in FIG. 3) until the rib 128 is carried nearly a full revolution to the position illustrated in FIG. 7. In this position, the valve holder rib engaging face 130 engages the abutment face 120 on the closure body 50 to prevent further rotation of the shell 44 (in the counterclockwise direction as viewed in FIG. 7). In this position, the closure shell 44 and valve holder 48 carried therein have been raised to the elevated, open position (FIGS. 8 and 9) by virtue of the engagement between the closure body threads 72 and the closure shell threads 76. In the elevated, open position, the closure permits the container contents to flow through the discharge aperture 60, past the occlusion member baffle plate 114, and through the valve 46 when the container is subjected to sufficient pressure.

If desired, the closure design may be modified to incorporate additional frictional resistance between the closure components at the closed and opened positions. In particular, two beads may be provided on the exterior circumference of the valve holder annular wall 110. (These beads are not illustrated in the first embodiment shown in FIGS. 1–9.) One such bead would be located near the bottom of the annular wall 110 and the other bead would be located near the top of the annular wall 110. The optional exterior bead near the top of the annular wall 110 would provide increased frictional engagement with the bead 66 on the closure body sleeve 64, and this would serve to hold the closure shell 44 (and valve holder 64 carried therein) at the lowered, closed position with a greater retention force. This would reduce the chances of the closure being inadvertently opened when the exterior surface of the container 42 and/or closure shell 44 are subjected to miscellaneous, externally applied loads during shipping and handling which might result in the application of torque tending to move the closure shell 44 away from the fully closed and sealed position.

The optional exterior bead near the bottom of the valve holder annular wall 110 would function when the closure shell 44 (and valve holder 48 carried therein) are raised to the elevated, open position (FIGS. 8 and 9). In the open position, such a bead on the exterior, lower end of the annular wall 110 would engage the bead 66 on the closure body sleeve 64 and provide a stronger frictional engagement which would aid in holding the closure shell 44 in the elevated, open position. Such an increased engagement force would be sufficient to withstand normal handling and bumping by the user of the container without causing the shell 44 to be screwed back downwardly away from its fully elevated, open position. A moderate amount of force would be required to overcome the frictional engagement between the beads before the closure shell 44 could be lowered to the closed position. This would typically be done only when the container is to be packed for travel or stored for a long period of time.

A second embodiment of a closure of the present invention is illustrated in FIGS. 10–32 and is represented generally in many of those figures by reference numeral 40A. The closure 40A is adapted to be disposed on a container (not illustrated) similar to the type of flexible container 42 illustrated in FIGS. 1 and 4 and described in detail above. However, the closure 40A has a generally oval exterior configuration and is thus especially suitable for use on a container having a body with an oval cross-sectional configuration and a neck with a circular cross-sectional configuration.

As with the first embodiment illustrated in FIGS. 1–9, the second embodiment closure and container may be stored and used in the orientation wherein the closure 40A is at the top of the container. The container 42 may also be normally stored in an inverted position (not illustrated). When stored in the inverted position, the container would employ the closure 40A as a support base.

The container is typically a squeezable container having a flexible wall or walls which can be grasped by the user and compressed to increase the internal pressure within the container so as to squeeze the product out of the container when the closure is opened (as explained in detail hereinafter). The container wall typically has sufficient, inherent resiliency so that when the squeezing forces are removed, the container wall returns to its normal, unstressed shape.

Figure 11:
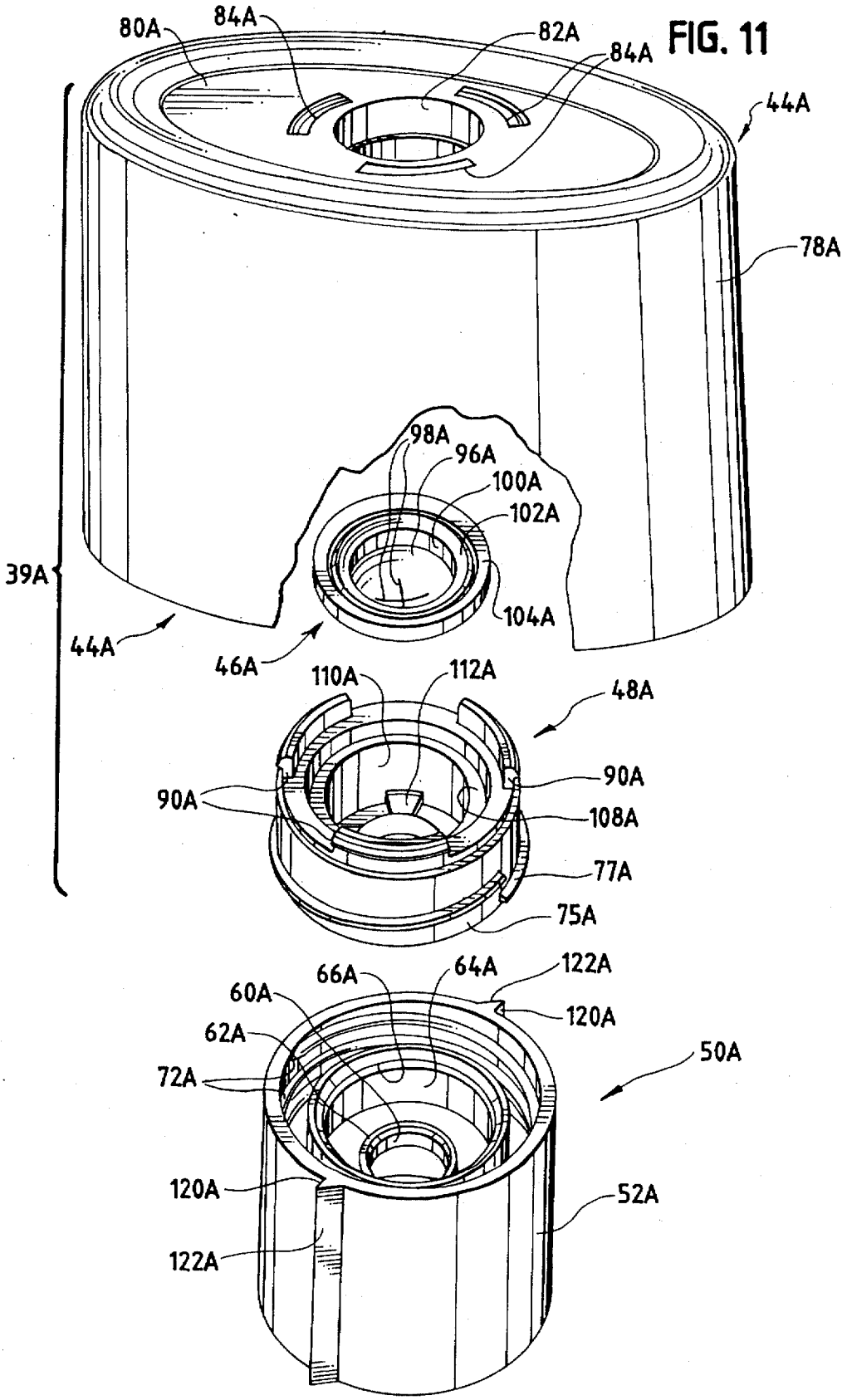
FIG. 11 is an exploded, perspective view of the closure shown in FIG. 10, and FIG. 11 also shows portions cut away to illustrate interior detail.

The closure 40A includes a base or body 50A to which is mounted a movable housing 39A (FIG. 11). The housing 39A comprises an exterior shell 44A, a valve 46A, and a valve holder 48A. The housing 39A may also include a removable and disposable seal cover (not illustrated) identical with the cover 45 in the first embodiment illustrated in FIGS. 1 and 2.

As illustrated in FIGS. 11, 22–25, and 27–32, the body 50A includes an outer annular wall 52A which has a conventional, snap-fit bead 54A (FIG. 24) or other suitable means (e.g., a conventional thread (not illustrated)) for engaging suitable cooperating means, such as a snap-fit bead on the container neck to secure the closure body 50A to the container.

Partway up the annular outer wall 52A, the closure body 50A has a transverse deck 56A (FIG. 24) which is adapted to extend over the upper, distal end of the container neck. The deck 56A has a downwardly extending, annular, flexible seal 58A which is received against the inner edge of the container neck in the container neck opening so as to provide a leak-tight seal between the closure body deck 56A and the container neck (in the same way that the first embodiment seal 58 functions to seal against the container neck 41 as shown in FIG. 4).

Figure 24:
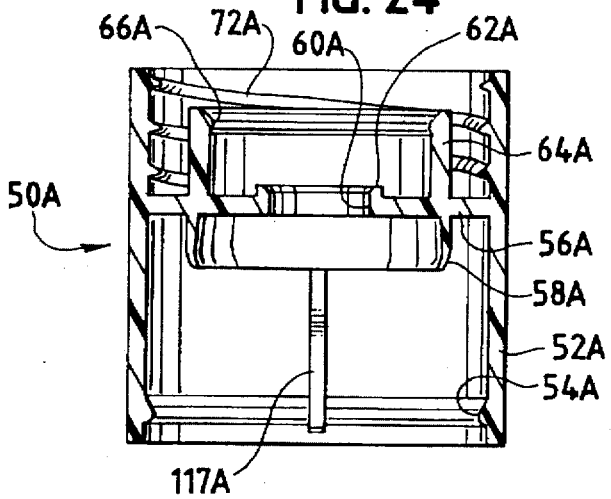
FIG. 24 is a cross-sectional view taken generally along the plane 24—24 in FIG. 23.
Figure 25:
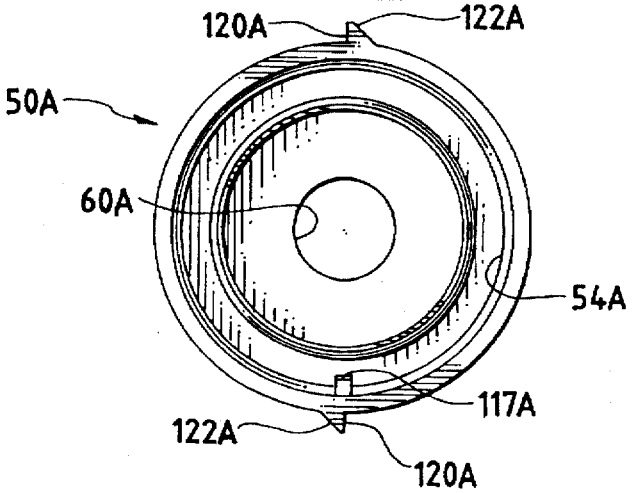
FIG. 25 is a bottom plan view of the closure body shown in FIG. 22.

As illustrated in FIGS. 11 and 24, the closure body deck 56A defines a discharge aperture 60A over the container neck opening. A collar 62A projects upwardly from the closure body deck 56A around the discharge aperture 60A. A larger diameter sleeve 64A is annularly disposed relative to the collar 62A and projects upwardly from the body deck 56A outwardly of the collar 62A. The sleeve 64A defines an inwardly extending seal bead 66A near the top of the sleeve.

Figure 27:
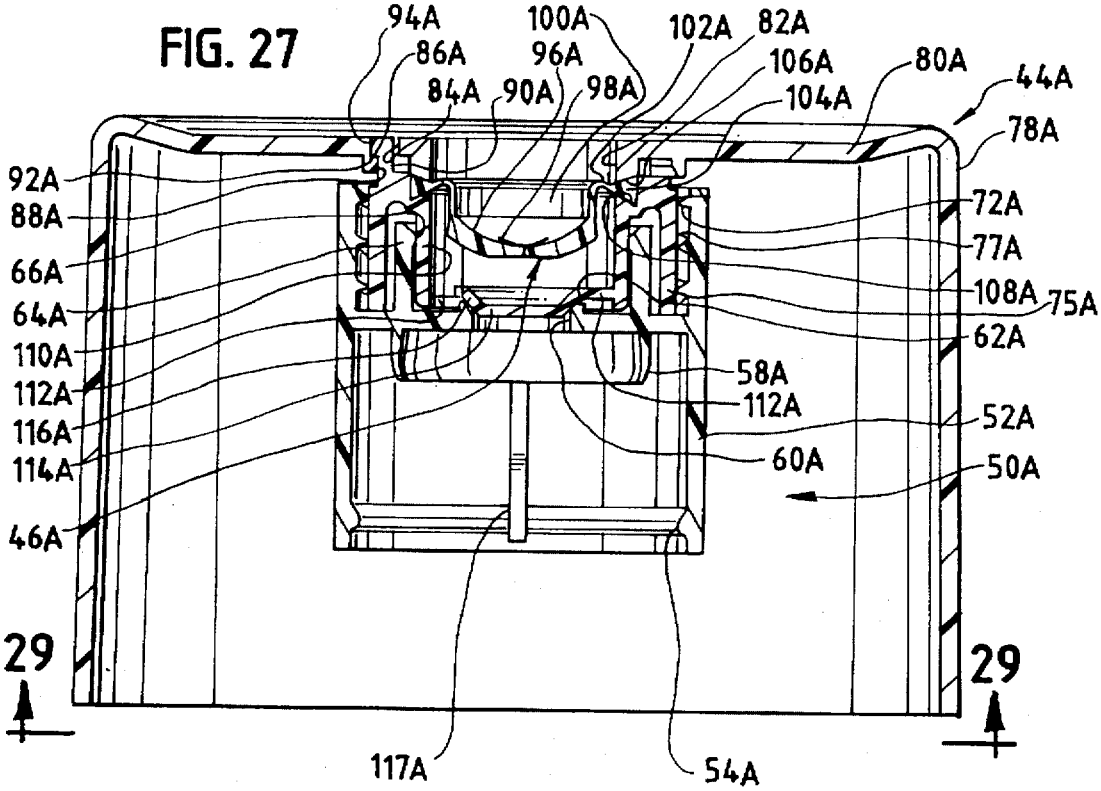
FIG. 27 is a cross-sectional view taken generally along the plane 27—27 in FIG. 26.
Figure 28:
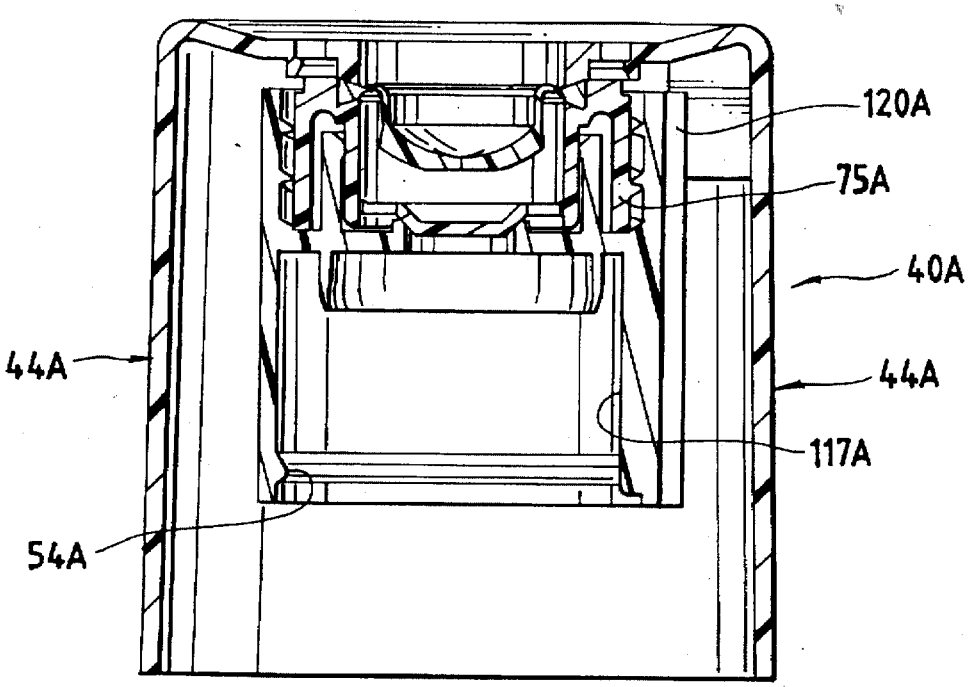
FIG. 28 is cross-sectional view taken generally along the plane 28—28 in FIG. 26.

Above the deck 56A, the inner surface of the closure body outer annular wall 52A defines a thread 72A. The closure body thread 72A is employed to engage the closure housing valve holder 48A as illustrated in FIGS. 27 and 28. To this end, the valve holder 48A has an outer, annular wall 75A (FIGS. 11 and 18–20) for being concentrically disposed within the closure body outer wall 52A, and the exterior surface of the valve holder wall 75A defines a male thread 77A for engaging the female thread 72A on the closure body annular, outer wall 52A.

The upper portion of the valve holder 48A is adapted to be attached to the housing shell 44A for clamping the valve 46A in position in the closure. The housing shell 44A has a cooperating receiving structure for receiving and holding the valve holder 48A. In particular, as shown in FIGS. 10–15, the closure outer shell 44A has an oval wall 78A which terminates in a transverse, top wall 80A defining apertures 84A for receiving portions of the valve holder 48A as described in more detail hereinafter.

The top wall 80A also defines a dispensing passage 82A. Preferably, as shown in FIG. 27, the dispensing passage 82A is centrally disposed and is concentric with the closure body discharge aperture 60 (and container neck opening). The dispensing passage 82 is preferably covered with a seal cover, such as the seal cover 45 described above with reference to the first embodiment illustrated in FIGS. 1 and 2.

Typically, the seal cover is intended to be disposable and may function as an initial tamper-evident cover which also prevents ingress of contaminants into the valve area during shipping and storage and when the container is displayed by a retailer for purchase. The cover may be a plastic and/or metal foil film with a suitable adhesive coating for initially attaching the cover to the transverse top wall 80A of the closure shell 44A over the dispensing passage 82A.

Figure 12:
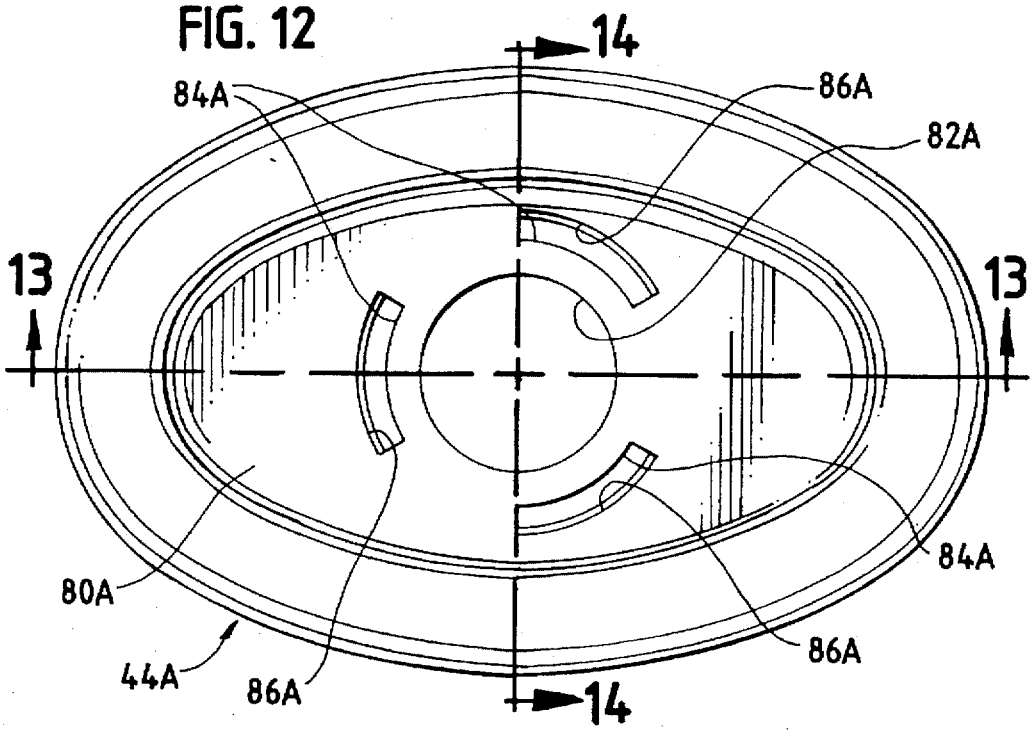
FIG. 12 is a top plan view of only the housing shell of the closure illustrated in FIG. 10, and FIG. 12 omits the housing valve, the housing valve holder, and the closure body.
Figure 13:
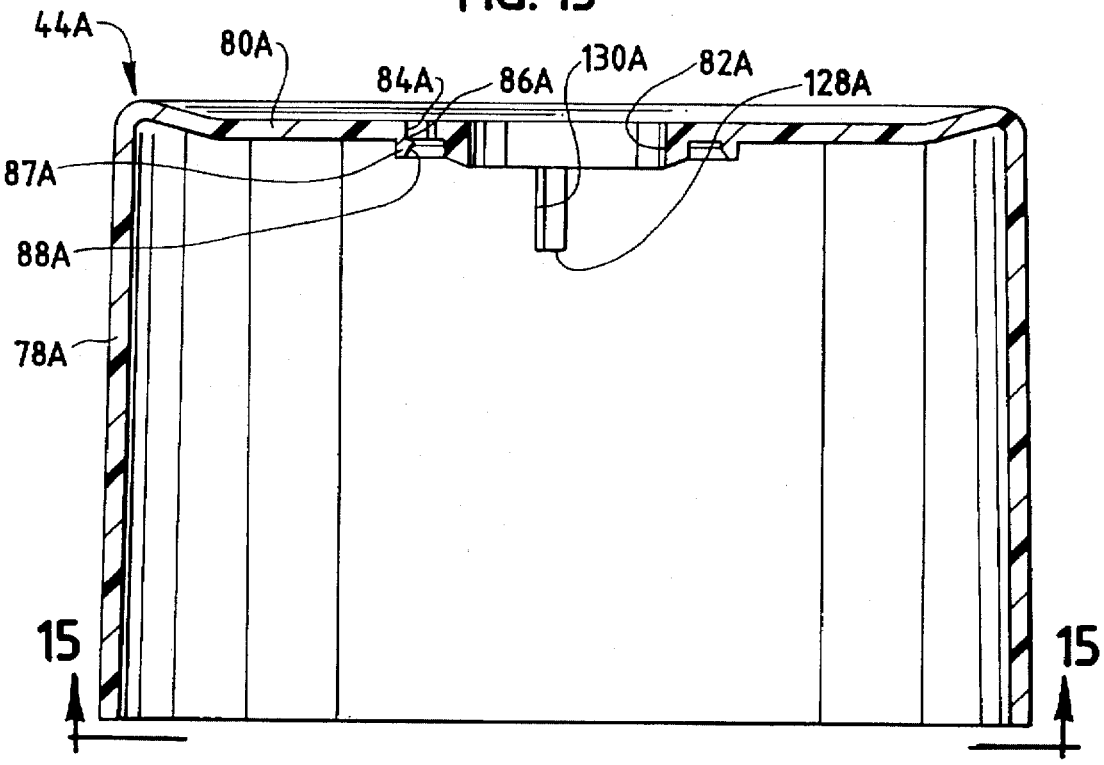
FIG. 13 is a cross-sectional view taken generally along plane 13—13 in FIG. 12.
Figure 14:
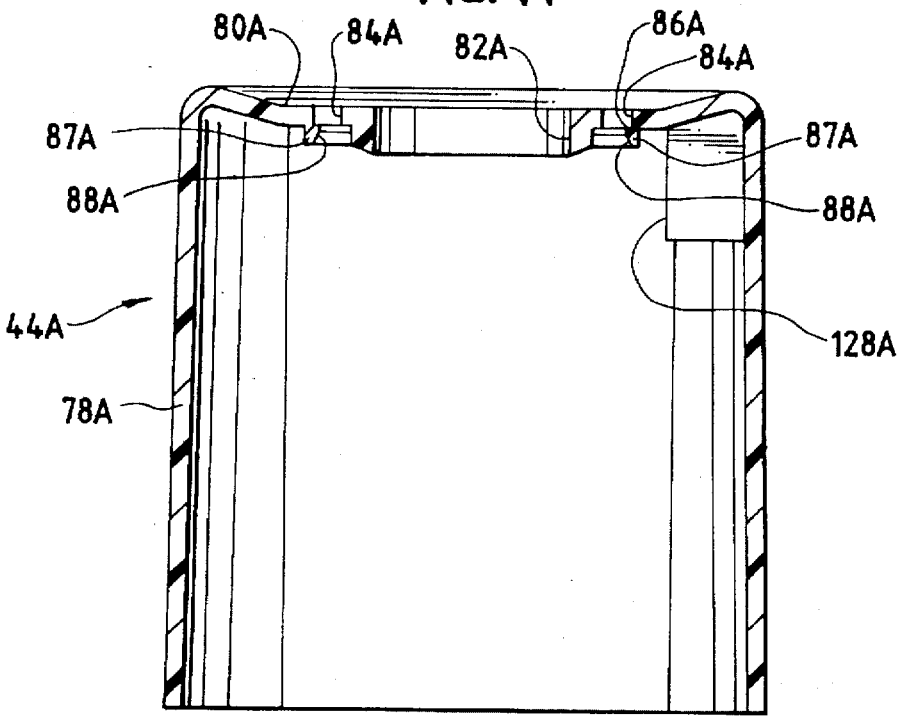
FIG. 14 is a cross-sectional view taken generally along the plane 14—14 in FIG. 12.
Figure 15:
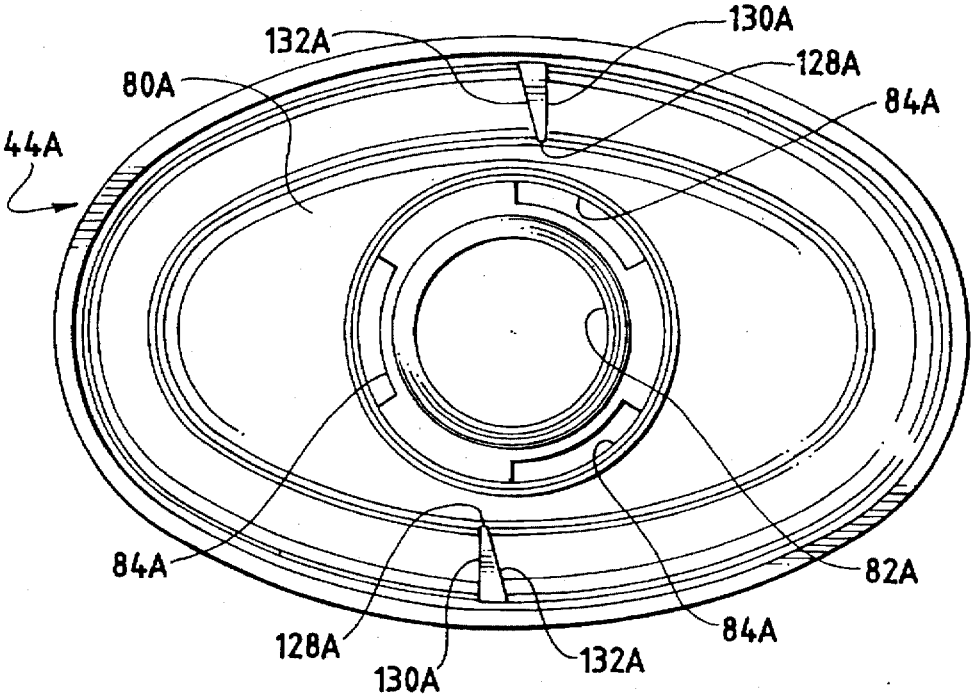
FIG. 15 is a bottom plan view taken generally along the plane 15—15 in FIG. 13.

As illustrated in FIGS. 12–15, the transverse top wall 80A defines three equal size slots 84A which are spaced apart at 120° increments on a circular locus concentric with the dispensing passage 82A. Each slot 84A has a circular arc configuration and extends through the transverse top wall 80A. The outer radial arc wall of each slot 84A terminates in a bottom shoulder 86A as illustrated in FIGS. 12–14. The shoulder 86A extends radially inwardly and faces upwardly. Each shoulder 86A is defined by a flange 87A projecting downwardly from the transverse top wall 80A at the outer edge of the slot 84A. Each flange 87A has an angled camming surface 88A as illustrated in FIG. 14.

Figure 26:
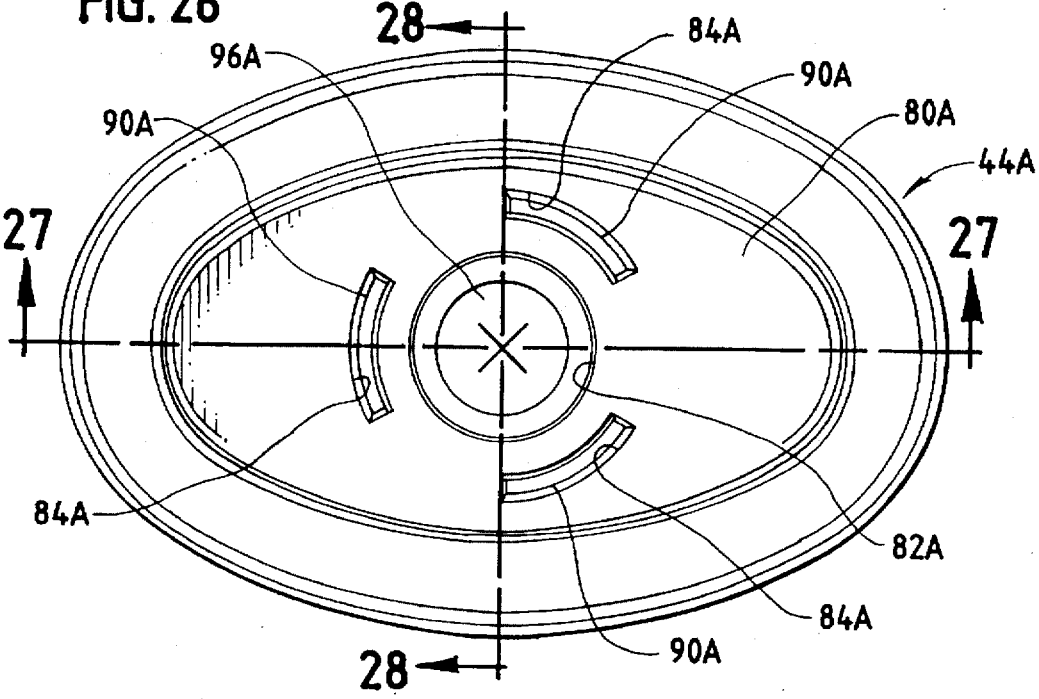
FIG. 26 is a top plan view of the assembled second embodiment of the closure which is shown in perspective in FIG. 10 and in exploded perspective in FIG. 11, the assembled closure being shown with the housing in the lowered, closed position.

The slots 84A form part of the retention system for holding the valve holder 48A and valve **46*a* to the outer shell transverse top wall 80A. To this end, the valve holder 48A includes three upwardly projecting, resilient arms 90A (FIGS. 16–20). The upper, distal end of each arm 90A has a downwardly facing lip 92A as illustrated in FIGS. 16 and 18–20. In order to initially assemble the housing 39A (as at a manufacturing facility), the valve 46A is placed in the valve holder 48A, and the valve holder 48A is then pushed with the valve 46A upwardly against the underside of the outer shell transverse top wall 80A while the valve holder arms 90A are aligned in registry with the slots 84A in the top wall 80A (FIG. 11). Each arm 90A is elastically deformed as it is inserted through the associated slot 84A (FIGS. 26 and 27). To assist in this assembly process, the distal end of each arm 90A has a curved or angled camming surface 94A (FIGS. 16, 18–20, and 27) for engaging the adjacent cam surface 88A (FIG. 27) on the shell flange 87A as the arms 90A move upwardly into the slots 84A. When the valve holder 48A has pushed the valve 46A against the transverse top wall 80A in the dispensing passage 82A, the lips 92A on the valve holder arms 90A are at an elevation that is just sufficient to clear the upwardly facing shoulders 86A in the slots 84A. Each arm 90A can then spring back to its original, undeformed orientation to position the lip 92A over, and in engagement with, the adjacent slot shoulder 86A. This retains the valve holder 48A on the shell 44A with the valve 46A clamped between the shell 44A and valve holder 48A**.

In the preferred form of the valve 46A illustrated, the valve 46A is identical with the valve 46 described above for the first embodiment of the closure 40 illustrated in FIGS. 1–9. The valve 46A functions in the second embodiment of the closure 40A in the same manner that the valve 46 functions in the first embodiment as has been described in detail above.

The valve 46A includes a flexible, central wall 96 (FIGS. 11 and 27) which has an outwardly concave configuration and which defines at least one, and preferably two, dispensing slits 98A extending through the central wall 96A. The intersecting slits 98A define four, generally sector-shaped, flaps or petals in the concave, central wall 96A. The flaps open outwardly from the intersection point of the slits 98A in response to increasing pressure of sufficient magnitude in the well-known manner as previously described.

The valve 46A includes a skirt 100A (FIG. 27) which extends outwardly from the valve central wall 96A. At the outer (upper) end of the skirt 100A there is a thin, annular flange 102A (FIG. 27) which extends peripherally from the skirt 100A in a downwardly angled orientation. The thin flange 102A terminates in an enlarged, much thicker, peripheral flange 104A which has a generally dovetail shaped transverse cross section.

To accommodate the seating of the valve 46A in the valve holder 48A as shown in FIG. 27, the underside of the housing deck 80A defines an annular, downwardly facing, angled clamping surface 106A for engaging the top of the valve flange 104A. The bottom of the valve flange 104A is engaged by an annular shoulder in the valve holder 48A which defines an upwardly angled, annular seating surface 108A.

The spacing between the deck clamping surface 106A and the valve holder seating surface 108A increases with increasing radial distance from the center of the valve 46A. Such a configuration defines an annular cavity with a transverse cross section having a dovetail shape which generally conforms to the cross-sectional shape of the valve flange 102A.

This clamping arrangement securely holds the valve 46A in the valve holder 48A without requiring special internal support structures or bearing members adjacent the interior surface of the valve cylindrical skirt 100A. This permits the region adjacent the interior surface of the valve skirt 100A to be substantially open, free, and clear so as to accommodate movement of the valve skirt 100A.

When the valve 46A is properly mounted within the valve holder 48A as illustrated in FIGS. 27 and 28, the valve 46A is recessed relative to the outer, top surface of the housing shell deck 80A. This affords substantial protection of the valve 46A and generally reduces the likelihood that the valve will be inadvertently contacted or damaged by external instrumentalities after removal of the closure seal cover (e.g., such as cover 45 illustrated for the first embodiment in FIGS. 1 and 2). However, when the container is squeezed and the contents are being dispensed through the valve 46A (as described in detail in the U.S. Pat. No. 5,439,143), then the valve central wall 96A is forced outwardly from its recessed position.

Figure 18:
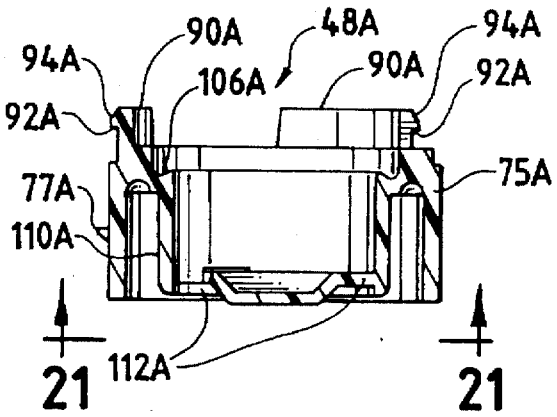
FIG. 18 is a cross-sectional view taken generally along the plane 18—18 in FIG. 17.
Figure 19:
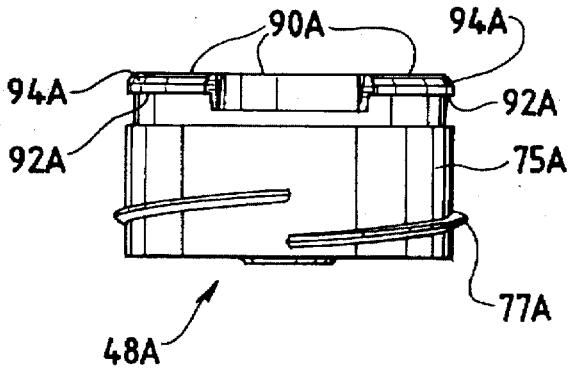
FIG. 19 is a side elevational view taken generally along the plane 19—19 in FIG. 17.
Figure 20:
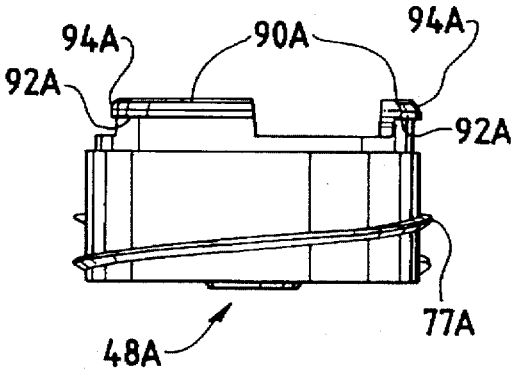
FIG. 20 is a side elevational view taken generally along the plane 20—20 in FIG. 17.
Figure 21:
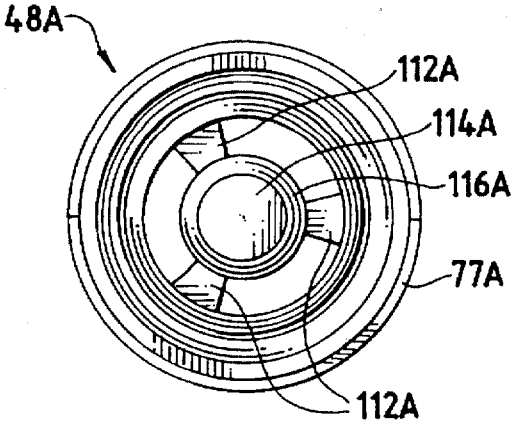
FIG. 21 is a bottom plan view taken generally along the plane 21—21 in FIG. 18.
Figure 16:
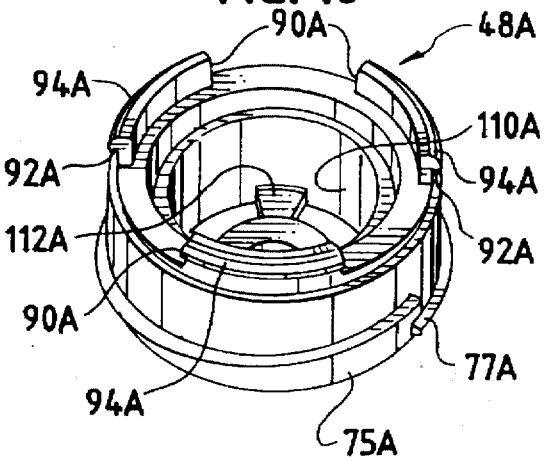
FIG. 16 is a perspective view of the valve holder of the closure of the second embodiment.
Figure 23:
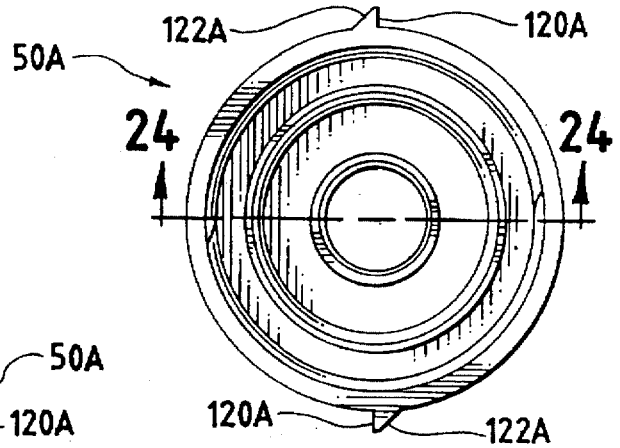
FIG. 23 is a top plan view of the closure body shown in FIG. 22.

The valve holder 48A also includes a downwardly extending annular wall 110A (FIGS. 16 and 18). The wall 110A defines a continuation of the dispensing passage 82A below the valve 46A. Projecting radially inwardly from the lower end of the wall 110A are three arms 112A (FIGS. 16, 17, 18, and 21), and the arms 112A support a centrally disposed baffle plate, plug, or occlusion member 114A. The arms 112A are circumferentially spaced at 120° increments.

The baffle plate 114 is a disk-like structure with a frustoconical rim 116A. The baffle plate 114A also functions as occlusion member or plug for blocking flow through the discharge aperture 60A as shown in FIG. 27. The rim 116A is received within the discharge aperture 60A so as to create a leak-tight seal against the collar 62A as illustrated in FIG. 27.

Figure 30:
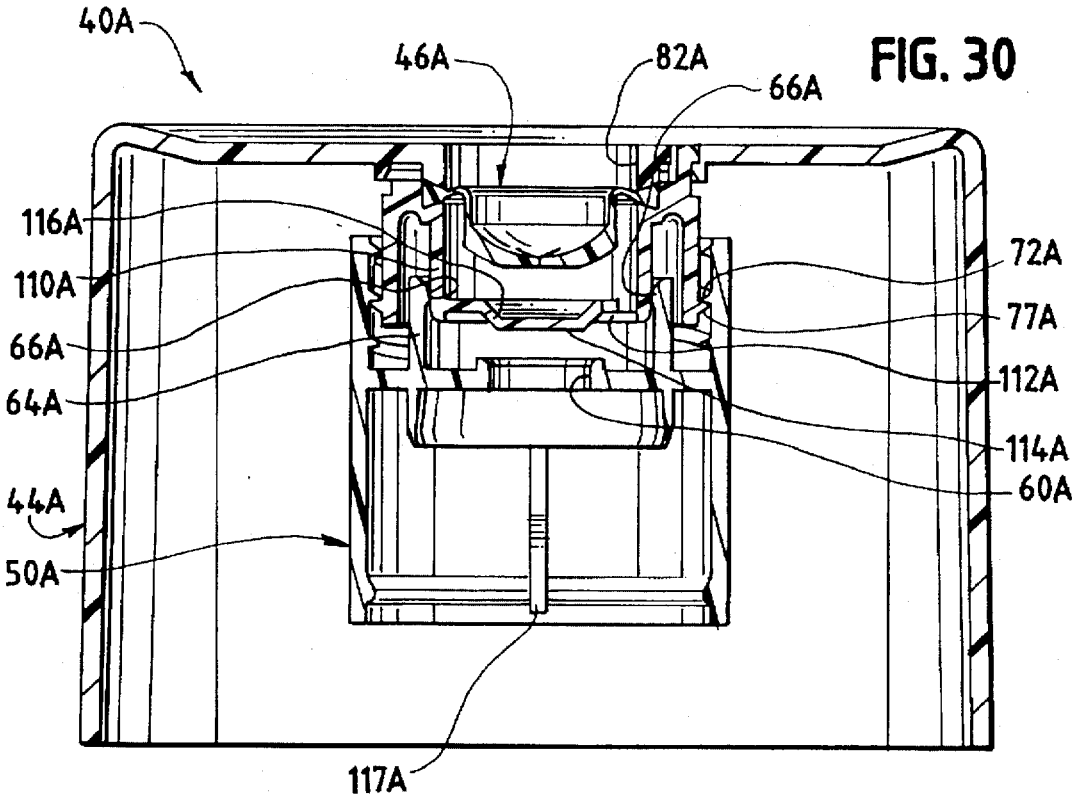
FIG. 30 is a cross-sectional view similar to FIG. 27, but FIG. 30 shows the closure housing in the elevated, open position.
Figure 31:
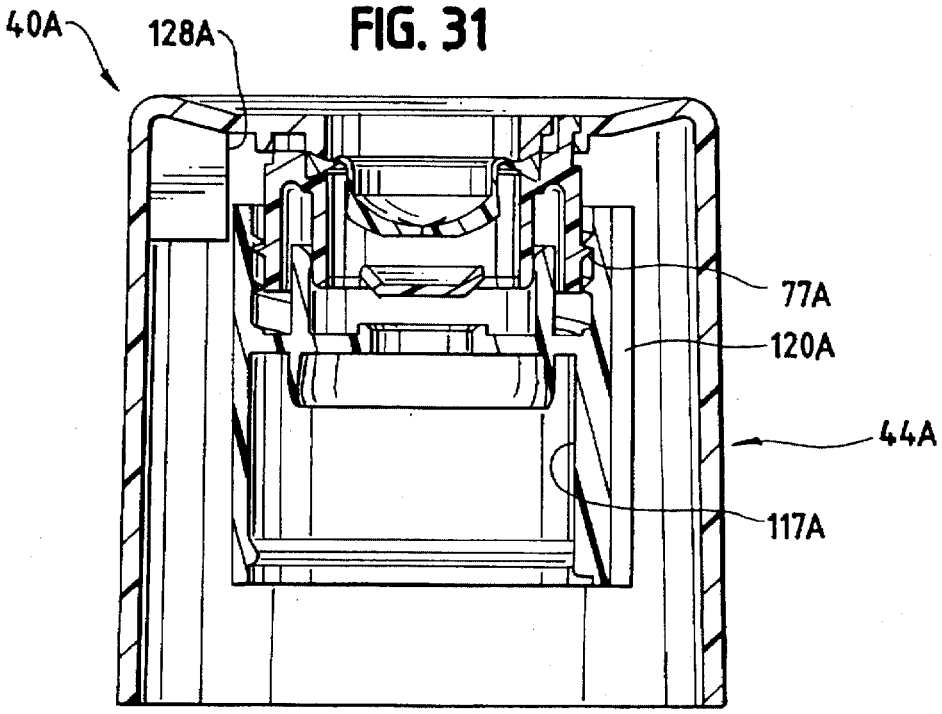
FIG. 31 is a view similar to FIG. 28, but FIG. 31 shows the closure housing in the elevated, open position.

The baffle plate 114A (with its sealing rim 116A and arms 112A) is adapted to move up and down with the entire housing 39A (which comprises the valve holder 48A, valve 46A, housing shell 44A (and seal cover, if provided)). The plate 114A moves between the lowered closed, position (FIGS. 27 and 28) and the elevated open position (FIGS. 30 and 31). In the elevated position (FIG. 30), the exterior surface of the valve holder annular wall 110A remains in a leak-tight, sealing engagement with the seal bead 66A on the inner surface of the closure body sleeve 64A. This defines a closed passage beneath the valve 46A and above the discharge aperture 60A. When the contents of the container are dispensed through the discharge aperture 60A, the contents flow through the discharge aperture 60A, past the baffle plate 114A, between the arms 112A, and into the region below the valve 46A in the dispensing passage 82A. The container contents can then be dispensed through the valve 46A if the valve is forced open by sufficient internal pressure generated by squeezing the container in the known manner (as described in detail in U.S. Pat. No. 5,429,143).

It will be appreciated that the baffle plate 114A also functions to minimize undesirable impacts on the inside of the valve 46A, as when the container is being squeezed excessively hard or shaken.

When the closure 40A is manufactured and initially assembled on the container, the closure 40A is typically initially arranged in the lowered, closed condition (FIGS. 10 and 26–29). This is also the condition in which the container can be conveniently carried in a user's suitcase while the user is travelling. In the closed condition, increased pressure in the container will be prevented from acting on the valve 46A because of the occlusion of the closure body discharge aperture 60A by the baffle plate or occlusion member 114A.

Figure 32:
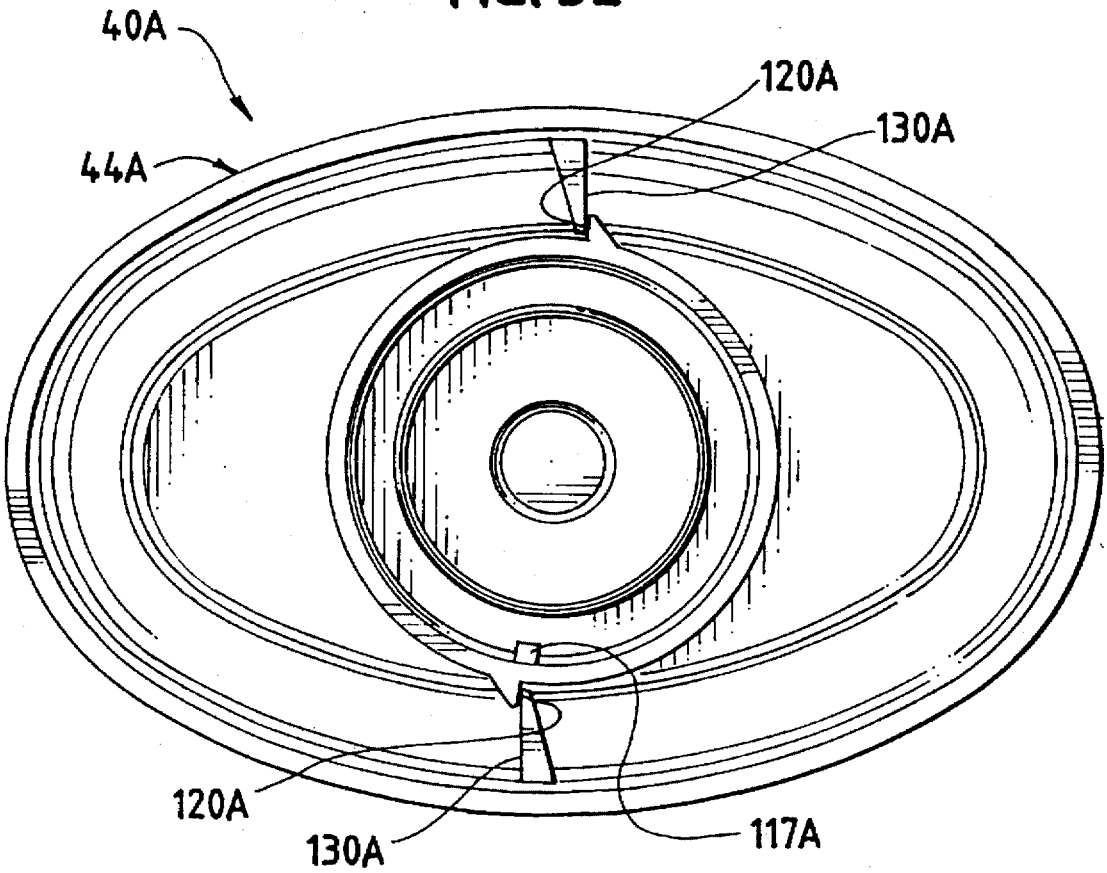
FIG. 32 is a bottom plan view similar to FIG. 29, but FIG. 32 shows the closure housing in the elevated, open position and having been rotated about 180° from the position illustrated in FIG. 29.

When it is desired to dispense some or all of the contents from the container, the closure 40A can be placed in the open condition (FIGS. 30–32). This is conveniently effected by rotating the closure shell 44A (in the counterclockwise direction looking down on the top of the housing shell 44 as viewed in FIGS. 10 and 26). The threaded engagement between the housing shell 44A and the closure body 50A results in the relative axial displacement between the closure body 50A and the closure housing 39A (which includes the shell 44A along with the valve holder 48A and valve 46A mounted thereto).

Means are provided for preventing the closure 40A from rotating relative to the container at the snap-fit connection (bead 54A in FIG. 27). In particular, the wall 52A of the closure body 50A includes an inwardly projecting, vertical rib 117A (FIGS. 27 and 28). The rib 117A is adapted to engage a suitable, mating receiving structure (e.g., notch, groove, etc.) on the container neck. This provides a resistance to applied torques and this resistance is sufficient to prevent the closure body 50A from turning on the container neck when the user screws the closure housing shell 44A upwardly or downwardly.

A system is provided for establishing the maximum axial displacement between the closure body 50A and the closure housing shell 44A. In the fully closed position, the axial movements of the closure body 50A and housing shell 44A toward each other are limited by the sealing engagement between the rim 116A of the baffle plate or occlusion member 114A and the closure body collar 62A (FIGS. 27 and 28). The axial movements of the body and shell toward each other are limited by engagement of the member 116A and collar 62A to ensure proper sealing when the collar 62A is in the lowered, closed position.

Figure 22:
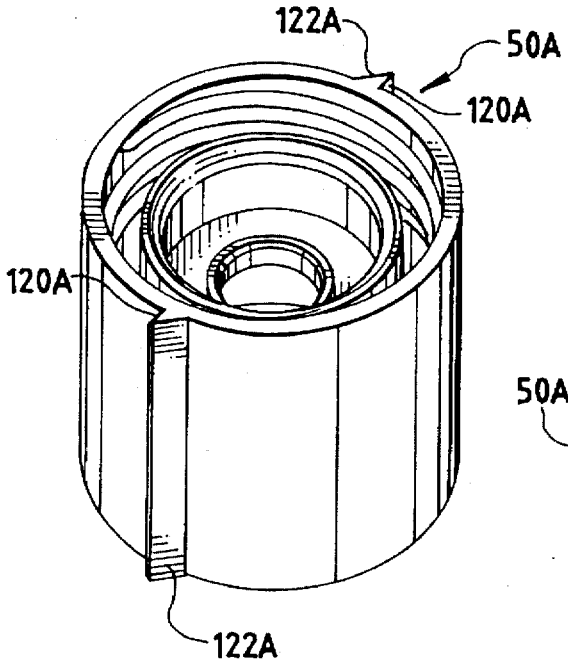
FIG. 22 is a perspective view of the closure body of the second embodiment of the closure.
Figure 29:
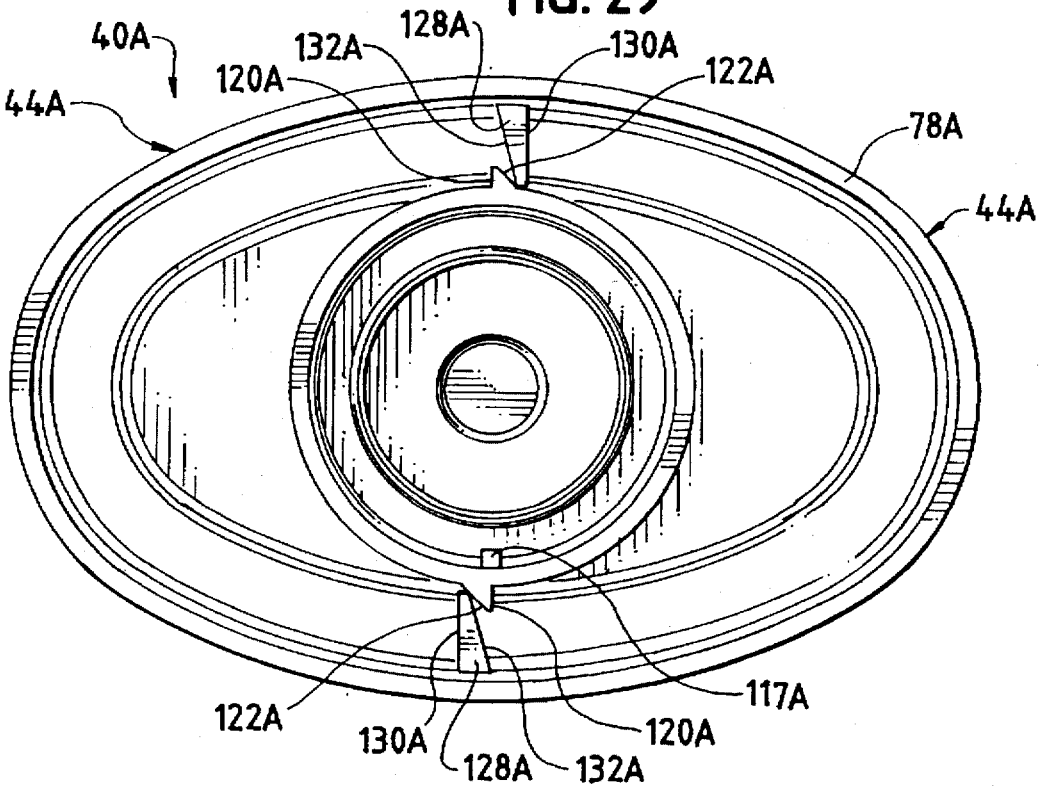
FIG. 29 is a bottom plan view of the assembled closure taken generally along the plane 29—29 in FIG. 27.

When the closure housing 44A is rotated to raise the housing 39A relative to the closure body 50A, a rotation limit structure operates to limit the rotation at the predetermined, maximum opening elevation (FIGS. 30 and 31). In particular, as illustrated in FIGS. 11, 22, and 29, the closure body outer wall 52A includes two radially outwardly projecting abutments each defined by a radial abutment face 120A and an angled surface 122A. As illustrated in FIG. 29, the radial abutment face 120A forms an acute angle with the surface 122A. Each abutment face 120A is preferably a planar surface lying on a radius of the cylindrical annular wall 52A of the closure body 50A.

Each closure body abutment face 120A is designed to be engaged by a stop member or rib 128A on the closure housing shell 78A. As illustrated in FIGS. 13 and 29, there are two ribs 128A which each project inwardly from the peripheral wall 78A of the closure housing shell 44A. As illustrated in FIG. 32, each rib 128A has an engaging face 130A which lies in a plane oriented radially relative to the circular configurations of the valve holder 48A and closure body 50A. Each rib 128A also has an angled surface 132A (FIG. 29) which faces slightly inwardly. When the closure housing shell 44A and the attached valve holder 48A are in the lowered, closed position (FIGS. 27–29), the angled surface 132A of each rib 128A lies generally alongside the angled surface 122A of the adjacent closure body abutment.

To place the closure 40A in the open condition, the closure shell 44A is rotated (counterclockwise as viewed in FIGS. 26 and clockwise as viewed in FIG. 29) until the ribs 128A are carried nearly a half revolution to the position illustrated in FIG. 32. In this position, the valve holder rib engaging faces 130A engage the abutment faces 120A on the closure body 50A to prevent further rotation of the shell 44A in the opening direction. In this position, as shown in FIG. 30, the closure shell 44A (and valve holder 48A carried therein) have been raised to the elevated, open position (FIGS. 30 and 31) by virtue of the engagement between the closure body threads 72A and the valve holder threads 77A. In the elevated, open position, the closure 40A permits the container contents to flow through the discharge aperture 60A, past the occlusion member baffle plate 114A, and through the valve 46A when the container is subjected to sufficient pressure.

If desired, the closure design may be modified to incorporate additional frictional resistance between the closure components at the closed and opened positions. In particular, two beads may be provided on the exterior circumference of the valve holder inner annular wall 110A. (These beads are not illustrated in the second embodiment shown in FIGS. 10–22.) One such bead would be located near the bottom of the annular wall 110A and the other bead would be located near the top of the annular wall 110A. The optional exterior bead near the top of the annular wall 110A would provide increased frictional engagement with the bead 66A on the closure body sleeve 64A, and this would serve to hold the closure shell 44A (and valve holder 48A carried therein) at the lowered, closed position with a greater retention force. This would reduce the chances of the closure being inadvertently opened when the exterior surface of the container and/or closure shell 44A are subjected to miscellaneous, externally applied loads during shipping and handling which might result in the application of torque tending to move the closure shell 44A away from the fully closed and sealed position.

The optional exterior bead near the bottom of the valve holder annular wall 110A would function when the closure shell 44A (and valve holder 48A carried therein) are raised to the elevated, open position (FIGS. 30 and 31). In the open position, such a bead on the exterior, lower end of the annular wall 110A would engage the bead 66A on the closure valve body sleeve 64A and provide a stronger frictional engagement which would aid in holding the closure shell 44A in the elevated, open position. Such an increased engagement force would be sufficient to withstand normal handling and bumping of the container by the user without causing the shell 44A to be screwed back downwardly away from its fully elevated, open position. A moderate amount of force would be required to overcome the frictional engagement between the beads before the closure shell 44A could be lowered to the closed position. This would typically be done only when the container is to be packed for travel or stored for a long period of time.

A variety of different sizes and shapes of containers can be readily provided with the closure 40 o 40A having standardized housing components (shell 44 or 44A, valve holder 48 or 48A, valve 46 or 46A, and seal cover 45). These components can be provided to define a universal assembly design having a standard shape and standard dimensions. Then only the closure body 50 or 50A need be different for each different type or size of container. In particular, the annular wall 52 or 52A of the body 50 would be provided in the appropriate size and with the appropriate attachment means (e.g., snap-fit bead or thread) to match the container neck. The closure housing adjusting thread 76 or 77A would have a standard size to mate with the closure body thread 72 or 76A, respectively.

It will be appreciated that the closure of the present invention provides a system for covering an opening to a container with a self-closing valve. Further, the closure includes components which are movable between a closed position wherein the valve is sealed from the container and an open position wherein the valve is in communication with the container to accommodate dispensing of the container contents. The closure of the present invention is more aesthetically pleasing and has no lid which could interfere with the dispensing of the product from the container. Additionally, because there is no lid, the user's view of the dispensing process is not obscured.

It will also be appreciated that the closure of the present invention may be provided with a variety of dispensing passage structures. Although the illustrated embodiments employ a closure housing with a flexible slit-type dispensing valve in the dispensing passage, other types of valves may be emphasized.

Further, the guide system defined by the closure body thread (72 or 72A) and engaged closure housing thread (76 or 77A) may be instead provided by other mechanisms for effecting relative axial displacement between the components, such as suitable cam and cam follower designs.

It will be readily observed from the foregoing detailed description of the invention and from the illustrations thereof that numerous other variations and modifications may be effected without departing from the true spirit and scope of the novel concepts or principles of this invention.

What is claimed is:

1. A closure on a container having an interior, said closure comprising:

a body extending from said container and defining a discharge aperture communicating with said interior; and a housing disposed on said body for movement between a lowered position and a elevated position, said housing defining a dispensing passage aligned with said body discharge aperture for establishing communication between said body discharge aperture and the exterior of said housing, said housing including a dispensing valve disposed in said dispensing passage for opening to dispense fluid therethrough and for closing to occlude flow, said housing including an occlusion member aligned with said discharge aperture and said dispensing passage between said valve and said body discharge aperture to prevent flow from said discharge aperture into said dispensing passage below said valve when said housing is in said lowered position and to permit flow into said dispensing passage when said housing is in said elevated position.

2. The closure in accordance with claim 1 in which said body defines a snap-fit bead below said discharge aperture for engaging a mating snap-fit bead on said container.

3. The closure in accordance with claim 1 in which said body defines a helical female thread below said discharge aperture for engaging a mating male thread on said container.

4. The closure in accordance with claim 1 in which said housing comprises (1) an outer shell, (2) said valve, and (3) a valve holder clamping said valve against said outer shell.

5. The closure in accordance with claim 1 in which said closure body includes a rib projecting inwardly for engaging a structure on said container to prevent relative rotation between said container and said closure body.

6. The closure in accordance with claim 1 in which said body is formed separately from, but mounted to, said container.

7. A closure on a container having an interior, said closure comprising:

a body extending from said container and defining a discharge aperture communicating with said interior, said body defining a deck around said discharge aperture; and a housing disposed on said body for movement between a lowered position and an elevated position, said housing defining a dispensing passage for establishing communication between said body discharge aperture and the exterior of said housing, said housing including a dispensing valve disposed in said dispensing passage for opening to dispense fluid therethrough and for closing to occlude flow, said housing including an annular wall that defines said dispensing passage and that is movable with said housing toward and away from said deck, said housing including an occlusion member between said valve and said body discharge aperture to prevent flow from said discharge aperture into said dispensing passage below said valve when said housing in said lowered position and to permit flow into said dispensing passage when said housing is in said elevated position, said housing occlusion member including a disk-like member that is supported by arms extending inwardly from said annular wall and that defines a lower peripheral sealing surface for engaging said deck around said discharge aperture when said housing is in said lowered position.

8. The closure in accordance with claim 1 in which said body is formed separately from, but mounted to, said container.

9. A closure on a container having an interior, said closure comprising:

a body extending from said container and defining a discharge aperture communicating with said interior, said body having at least one projecting abutment member; and a housing disposed on said body for movement between a lowered position and an elevated position, said housing defining a dispensing passage for establishing communication between said body discharge aperture and the exterior of said housing, said housing including a dispensing valve disposed in said dispensing passage for opening to dispense fluid therethrough and for closing to occlude flow, said housing including an occlusion member between said valve and said body discharge aperture to prevent flow from said discharge aperture into said dispensing passage below said valve when said housing is in said lowered position and to permit flow into said dispensing passage when said housing is in said elevated position, said housing being rotatable on said body, said housing having at least one projecting stop member for being engaged by said abutment member at one of said lowered position and elevated position.

10. The closure in accordance with claim 9 in which said body is formed separately from, but mounted to, said container.

11. The closure in accordance with claim 9 in which said housing and body define an engaged guide system for moving said housing axially between said lowered and elevated positions-when said housing is rotated.

12. The closure in accordance with claim 11 in which said guide system includes a helical thread on said housing and an engaged helical thread on said body.

13. The closure in accordance with claim 12 in which said body thread is a male thread and said housing thread is a female thread.

14. The closure in accordance with claim 12 in which said body thread is a female thread and said housing thread is a male thread.

15. A closure on a container having an interior, said closure comprising:

a body extending from said container and defining a discharge aperture communicating with said interior;

a housing disposed on said body for movement between a lowered position and an elevated position, said housing defining a dispensing passage for establishing communication between said body discharge aperture and the exterior of said housing, said housing including a dispensing valve disposed in said dispensing passage for opening to dispense fluid therethrough and for closing to occlude flow, said housing including an occlusion member between said valve and said body discharge aperture to prevent flow from said discharge aperture into said dispensing passage below said valve when said housing is in said lowered position and to permit flow into said dispensing passage when said housing is in said elevated position, said outer shell having a transverse top wall defining a through slot with and an adjacent, upwardly facing shoulder; and said valve holder defining an upwardly projecting resilient arm with a downwardly facing lip at the upper distal end whereby said arm can be elastically deformed as it is inserted through said slot and can spring back to its original undeformed orientation to position said lip over, and in engagement with, said shoulder for retaining said valve holder on said outer shell with said valve clamped between said outer shell and valve holder.

16. The closure in accordance with claim 15 in which said body is formed separately from, but mounted to, said container.

17. A closure on a container having an interior, said closure comprising:

a body extending from said container and defining a discharge aperture communicating with said interior, said body having a helical thread; and said body having at least one projecting abutment member; and a housing on said body and having a helical thread that is threadingly engaged with said body thread whereby rotation of said housing effects movement of said housing between a lowered position and an elevated position, said housing defining a dispensing passage for establishing communication between said body discharge aperture and the exterior of said housing, said housing having at least one projecting stop member for engaging said body abutment member to terminate rotation of said housing at one of said lowered position and elevated position, said housing including a dispensing valve that is disposed in said dispensing passage for defining an orifice which opens to permit fluid flow therethrough in response to increased pressure within said container and closes to shut off fluid flow therethrough upon removal of the increased pressure, said housing including an occlusion member between said valve and said body discharge aperture to prevent flow from said discharge aperture into said dispensing passage below said valve when said housing is in said lowered position and to permit flow into said dispensing passage when said housing is in said elevated position.

18. The closure in accordance with claim 17 in which said body is formed separately from, but mounted to, said container.

19. The closure in accordance with claim 17 in which said body defines a deck around said discharge aperture;

said housing includes an annular wall that defines said dispensing passage and that is movable with said housing toward and away from said deck; and said housing occlusion member is a disk that is supported by arms extending inwardly from said annular wall and that defines a lower peripheral sealing surface for engaging said deck around said discharge aperture when said housing is in said lowered position.

20. The closure in accordance with claim 17 in which said body thread is a male thread and said housing thread is a female thread.

21. The closure in accordance with claim 17 in which said body thread is a female thread and said housing thread is a male thread.

22. The closure in accordance with claim 17 in which said body defines a snap-fit bead below said discharge aperture for engaging a mating snap-fit bead on said container.

23. The closure in accordance with claim 17 in which said body defines a helical female thread below said discharge aperture for engaging a mating male thread on said container.

24. The closure in accordance with claim 17 in which said housing comprises (1) an outer shell, (2) said valve, and (3) a valve holder clamping said valve against said outer shell.

25. The closure in accordance with claim 24 in which said outer shell has a transverse top wall defining a through slot with and an adjacent, upwardly facing shoulder; and said valve holder defines an upwardly projecting resilient arm with a downwardly facing lip at the upper distal end whereby said arm can be elastically deformed as it is inserted through said slot and can spring back to its original undeformed orientation to position said lip over, and in engagement with, said shoulder for retaining said valve holder on said outer shell with said valve clamped between said outer shell and valve holder.

26. The closure in accordance with claim 17 in which said closure body includes a rib projecting inwardly for engaging a structure on said container to prevent relative rotation between said container and said closure body.

* * * * *

UNITED STATES PATENT AND TRADEMARK OFFICE

CERTIFICATE OF CORRECTION

PATENT NO. : 5,680,969

DATED : October 28, 1997

INVENTOR(S) : Richard A. Gross

It is certified that error appears in the above-indentified patent and that said Letters Patent is hereby corrected as shown below:

Column 5, line 59, before "upwardly" insert --an--.

Column 7, line 42, "Cross-sectional" should be lower case --cross-sectional--.

Column 15, line 51, "o" should be --or--.

Column 16, line 31, "a elevated" should be --an elevated--.

Column 17, line 15, after "housing" insert --is--.

Column 17, line 23 (claim 8, line 1), "claim 1" should be --claim 7--.

Signed and Sealed this

Twenty-fourth Day of March, 1998

*Attest:*

Bruce Lehman

BRUCE LEHMAN

*Attesting Officer*

*Commissioner of Patents and Trademarks*